US008122917B2

(12) United States Patent
Harman et al.

(10) Patent No.: US 8,122,917 B2
(45) Date of Patent: Feb. 28, 2012

(54) APPARATUS AND METHOD FOR DISPENSING FOAM

(75) Inventors: Anthony David Harman, Oxon (GB); David Dakin Iowerth Wright, High Waycombe (GB); Jam Wilem Marinus Mijers, Haarlem (NL); Stuart Brian William Kay, Cambridge (GB); Christopher John Hurlstone, Cambridge (GB); Julina Richard Dixon, Cambridge (GB); Andrew Gordon Pocock, Cambridge (GB); Brendan Hogan, Co Galway (IE)

(73) Assignee: BTG International Limited, London (GB)

( * ) Notice: Subject to any disclaimer, the term of this patent is extended or adjusted under 35 U.S.C. 154(b) by 0 days.

(21) Appl. No.: 12/923,209

(22) Filed: Sep. 9, 2010

(65) Prior Publication Data

US 2011/0024448 A1 Feb. 3, 2011

Related U.S. Application Data

(63) Continuation of application No. 10/571,608, filed as application No. PCT/GB2004/003864 on Sep. 9, 2004, now Pat. No. 7,814,943.

(30) Foreign Application Priority Data

Sep. 10, 2003 (GB) ..... 0321210.7

(51) Int. Cl.
*B65B 1/04* (2006.01)

(52) U.S. Cl. ..... 141/18; 141/301; 222/482; 604/82

(58) Field of Classification Search ..... 141/18, 141/2, 302, 21, 25, 27, 99, 285, 301; 222/478, 222/479, 481, 482–486, 402.17; 604/82
See application file for complete search history.

(56) References Cited

U.S. PATENT DOCUMENTS 2,099,292 A * 11/1937 Brown ..... 222/478
(Continued)

FOREIGN PATENT DOCUMENTS

CA 2 238 118 1/2006
(Continued)

*Primary Examiner* — Gregory Huson
*Assistant Examiner* — Jason Niesz
(74) *Attorney, Agent, or Firm* — Nixon & Vanderhye

(57) ABSTRACT

A foam transfer device is described, for use with aerosol canister apparatus for producing a sclerosant foam for the treatment of, inter alia, varicose veins. The device enables diversion of an initial quantity of below-specification foam from the canister to waste, e.g. to an integral waste chamber, before dispensing a further quantity of foam for use in treatment. The switching of the flow from the waste chamber to a different outlet for use is accomplished without interrupting the flow from the aerosol canister since this would cause the foam to drop below specification again. The waste chamber may be transparent so that the foam entering it can be observed and a decision made by a user when to stop diverting foam to waste. Alternatively, the foam may be diverted automatically e.g. when a set time has elapsed or a set volume of foam dispensed. The foam for use is normally dispensed into a syringe for subsequent injection into a varicose vein of a patient.

7 Claims, 11 Drawing Sheets

U.S. PATENT DOCUMENTS

| | | | | |
|---|---|---|---|---|
| 3,540,448 | A | 11/1970 | Sunnen | |
| 3,656,482 | A | 4/1972 | Sunnen | |
| 3,711,030 | A * | 1/1973 | Jones | 239/397 |
| 3,955,571 | A | 5/1976 | Sunnen et al. | |
| 3,970,219 | A | 7/1976 | Spitzer et al. | |
| 4,019,657 | A | 4/1977 | Spitzer et al. | |
| 4,141,472 | A | 2/1979 | Spitzer et al. | |
| 4,174,386 | A | 11/1979 | Spitzer et al. | |
| 4,690,312 | A * | 9/1987 | Crapser et al. | 222/402.17 |
| 4,724,615 | A | 2/1988 | Mackles et al. | |
| 6,612,468 | B2 | 9/2003 | Pritchett et al. | |
| 2002/0010418 | A1 | 1/2002 | Lary et al. | |
| 2002/0070238 | A1 | 6/2002 | Pritchett et al. | |
| 2002/0077589 | A1 * | 6/2002 | Tessari | 604/82 |
| 2002/0107489 | A1 * | 8/2002 | Lee | 604/240 |
| 2002/0147462 | A1 | 10/2002 | Mair et al. | |
| 2007/0276323 | A9 * | 11/2007 | Matsuura et al. | 604/93.01 |

FOREIGN PATENT DOCUMENTS

| | | | |
|---|---|---|---|
| DE | 1 926 796 | | 3/1970 |
| DE | 19 26 796 | A | 3/1970 |
| EP | 1 190 775 | A1 | 3/2002 |
| EP | 1 189 818 | B1 | 6/2003 |
| FR | 1400129 | | 3/1965 |
| FR | 2140341 | | 1/1973 |
| FR | 2 710 558 | | 4/1995 |
| FR | 2710558 | | 4/1995 |
| FR | 2775436 | | 9/1999 |
| WO | WO 97/02909 | A1 | 1/1997 |
| WO | WO 97/29029 | A | 8/1997 |
| WO | WO 99/43371 | A1 | 9/1999 |
| WO | WO 00/66274 | A1 | 11/2000 |
| WO | WO 00/72821 | A1 | 12/2000 |
| WO | WO 02/41872 | A1 | 5/2002 |

* cited by examiner

APPARATUS AND METHOD FOR DISPENSING FOAM

CROSS REFERENCE TO RELATED APPLICATIONS

This application is a continuation of application Ser. No. 10/571,608 filed May 11, 2006, U.S. Pat. No. 7,814,943, which is a 371 of PCT/GB2004/003864 filed Sep. 9, 2004, which claims priority to 0321210.7 filed Sep. 10, 2003, the entire contents of each of which are hereby incorporated by reference.

APPARATUS AND METHOD FOR DISPENSING FOAM

The present invention relates to the dispensing of foam from a source of foam, e.g. from a pressurised canister which generates foam by passing liquid and gas through a fine mesh. The invention is suitable in particular for dispensing a precision foam such as a sterile clinical grade therapeutic foam, e.g. for the treatment of varicose veins.

WO 00/72821 describes apparatus and methods for generating a foam for treatment of varicose veins. In one of the embodiments described in that patent application, foam is generated by pressurising a sclerosant liquid and a physiological gas in a canister and releasing the mixture through a mesh whereby a stable foam is produced suitable for injection into varicosed blood vessels in sclerotherapy treatment. An apparatus is described which incorporates a three-way valve attached to the outlet of the foam generating canister. The first portion of foam generated by the canister tends to be of poor quality, and the valve allows this foam to be diverted to waste. The valve may then be switched over feed foam to a syringe for use in treatment. The disclosure of WO 00/72821 is incorporated herein by reference.

A number of technical problems have been identified in the course of further development of the canister based system described in WO 00/72821. These include the following.

1. When the three-way valve is switched from the waste position to the fill position, there is a momentary dead time when the valve is closed to both outlet ports and flow is completely obstructed. When the valve is fully set to the fill position and the flow re-commences, the foam is initially of poor quality; the canister has effectively re-started its delivery of foam.

2. In a delivery device, such as a syringe, for administering foam to a patient, there is normally a dead space. In the case of a syringe, this is within the bore of the luer connector on the syringe. As foam is directed from the valve to the syringe and pushes the plunger of the syringe back, a large bubble tends to form adjacent the plunger, which may become incorporated within the foam and undermine its quality.

3. It is desirable to be able to inspect the foam and to determine when consistent, good quality foam is being generated, so as to check that foam with the correct properties is being directed into a patient's vein. When foam of consistent quality is being produced, the valve can be adjusted so that foam is directed to the syringe rather than to waste. In the apparatus described in WO 00/72821, the foam is observable in a transparent tube communicating between the canister and valve unit (ref 35 in FIGS. 10 and 11). A difficulty with this is that the foam which is observed is some way back from the foam being delivered. Therefore it is possible to observe adequate quality foam in the tube and still be delivering inadequate quality foam to the syringe.

4. The waste foam from tube 38 is not contained.

5. The use of a relatively long tube 35 joining the canister to the valve is wasteful, since a quantity of foam sufficient to fill the tube will always be wasted.

6. The system is somewhat dependant on the skill of the operator to consistently produce a syringe full of good quality foam.

Although these problems have been discussed above in connection with the system described in WO 00/72821, they may be applicable to other systems for generating and dispensing foam of various sorts, where a uniform foam product having consistent, predetermined properties is required. The contents of WO 02/41872, which also relates to this field, is incorporated herein by reference.

A number of solutions to some or all of these problems have been devised by the inventors, as follows.

According to a first aspect of the invention, apparatus for dispensing foam comprises a source of foam and a dispensing device, the dispensing device comprising:

(a) an inlet in communication with the source of foam;

(b) a usable foam outlet; and (c) a waste bleed outlet communicating with the inlet, the bleed outlet having a higher resistance to flow of foam than that of the usable foam outlet.

In this arrangement, as with the other arrangements described below, the normal practice for clinical applications would be to connect a syringe to the usable foam outlet, normally via a luer connection. In such an arrangement, the syringe may be used as a manually operable valve on the usable foam outlet. One way of using this device is therefore to cause foam to be delivered from the source whilst holding the plunger of the syringe shut for a period of time until uniform foam of with acceptable properties is being produced. Alternatively, the usable foam outlet may simply be blocked off by the user's finger or thumb, or a valve may be incorporated as part of the device. Whilst the usable foam outlet is blocked off, foam flows to waste though the high resistance waste bleed. Once an initial quantity of unacceptable foam has been ported to waste, the usable foam outlet is then opened and foam exits from that outlet into whatever container or to whatever application is desired; normally this would be a syringe. During this time, a small quantity of foam will continue to "leak" from the waste bleed which is still open to the inlet. It is desirable that the flow of foam be slower through the bleed than through the usable foam outlet.

The initial quantity of foam which flows to waste may be between 0.25% and 50% of a volume of foam contained within or capable of being generated by the source. More preferably it is 0.5% to 20%, still more preferably 1% to 10%.

The term "outlet" is used throughout this specification to mean a channel leading to an orifice or port, together with the orifice or port itself.

It is possible to design the device so as to minimise dead space; one effective way of achieving this is to position the waste bleed adjacent to and/or communicating with the usable foam outlet. In a conventional syringe, there is normally dead air space in the luer nozzle; another way of reducing dead space in the system comprising assembled syringe and device is to use a different type of syringe. A syringe which has a projection on the end of the plunger which fits snugly into the luer (or other) nozzle would achieve this effect. Such syringes are available on the market, e.g. insulin syringes made by Henke, Sass, Wolfe in Germany.

If the system has been optimised to reduce dead space, then the sequence described above may be adequate. Alternatively, it may be desirable to purge dead space in the system as an additional step. One way of doing this is to stop generation of foam when the syringe is partly filled and then depress the syringe plunger to empty the contents of the syringe back through the waste bleed. In this way the syringe nozzle and all connecting passages in the device are filled with foam. This method requires that the usable foam outlet be in communication, optionally via a valve, with the waste bleed passage and/or with another waste outlet. The sequence is then started again: generation of foam by the source is re-started with the syringe plunger is held shut as previously described, so as to get rid of an initial quantity of foam to waste. The syringe plunger is then released so that the syringe fills, this time without any air pockets entering the syringe.

A potential difficulty with the sequence described in the preceding paragraph is that the step of discharging foam from the syringe into the device and thence out of the waste bleed is relatively slow because of the small dimensions of the bleed outlet. A solution to this problem is to provide a further waste outlet, preferably of larger dimensions and which offers less resistance to flow that the bleed. Preferably, a valve is provided to prevent the flow of foam directly from the inlet to this second, larger diameter waste outlet. However, the valve permits flow passing back from the usable foam outlet to pass through the larger waste outlet. The valve is preferably of the form of a diaphragm member located between the inlet and the larger diameter waste outlet. Such as valve is described in detail in EP 0884059 A2, the contents of which are incorporated herein by reference.

Preferably, a waste foam container is provided as an integral part of the device and this container preferably has a transparent wall or portion of a wall to allow observation of the wasted foam so that the user can check when the foam is of sufficient consistent quality to be used. For example, the device may comprise a housing which defines the various outlets and which also defines the container or chamber for waste. Preferably, in an arrangement with two waste outlets (i.e. bleed outlet and larger diameter waste outlet), both communicate with the waste chamber. The waste foam chamber may be filled or partially filled with an absorbent material such as blotting paper or cotton wool or the like. On contact with foam, such material absorbs the liquid component of the foam, breaking down the foam in the process. The benefits of using absorbent material are that the waste chamber may be made a lot smaller, and also that there is a reduced risk of liquid leaking out of the used container e.g. through the vent hole. It may, however, be less easy to observe the quality of the foam if absorbent material is incorporated in the waste chamber.

The first aspect of the invention also encompasses a device as described above together with a syringe, either in assembled form or as a kit. If in kit form, the source of foam may be provided as a separate element of the kit. The source is preferably a pressurised canister containing gas and liquid, which may include a mixing element such as a number of small, confluent apertures and/or a fine mesh or meshes through which gas and liquid pass in order to generate foam.

In the assembled apparatus with a syringe in place, it is preferred that the resistance to flow of foam offered by the waste bleed is greater than the combined resistance to flow of foam offered by the usable foam outlet with a syringe inserted in it, together with the resistance required to move back the plunger of the syringe connected to the usable foam outlet.

The first aspect of the invention also encompasses a dispensing device which does not include a source of foam but is adapted to be connected to or mounted on a source of foam such as a pressurised canister as described above. Such adaptation may be by means of formations which engage with complementary formations provided on the canister or other source of foam. Such an arrangement might be realised by supplying the dispensing device and canister (or other source) ready fitted with respective complementary parts of a connector device. The invention thus envisages a kit comprising a dispensing device and a source of foam such as a canister, with the canister and device being fitted with complementary connector devices. The source may comprise two canisters, a first containing liquid to be foamed and a second containing pressurised gas for charging the first canister prior to generation of foam. In this case the kit may comprise first and second canisters as described above, together with a dispensing device and, optionally, a syringe. A two can system is described in more detail in WO 02/41872 which is incorporated herein by reference.

The first aspect of the invention also encompasses the sequences of method steps described above.

In particular, according to the first aspect of the invention a method of dispensing foam comprises the steps of:—

(a) dispensing foam to waste;

(b) observing the said foam being dispensed to waste and making a determination as to when the foam is of a predetermined quality;

(c) once the foam is of the said predetermined quality, dispensing foam to a separate location for subsequent use, whilst continuing to dispense foam to waste;

(d) wherein the rate at which foam is dispensed to waste is lower than the rate at which foam is dispensed to the said separate location for subsequent use.

Step (b) may be replaced by the step of dispensing foam to waste for a predetermined period of time or dispensing a predetermined mass or volume of foam to waste. An additional visual check may then be made as to whether the foam is of a predetermined acceptable quality.

Also according to the first aspect of the invention a method of dispensing foam using apparatus as described above may comprise the steps of:

(a) providing a syringe sealingly fitted to the usable foam outlet of the dispensing device;

(b) whilst holding a plunger of the syringe in a fully depressed position, causing foam from the source to flow into the foam inlet of the dispensing device and thence out of the waste bleed outlet;

(c) observing the said foam exiting the waste bleed outlet;

(d) when the said foam exiting the bleed outlet is observed to have a predetermined quality, releasing the plunger of the syringe, whereby the syringe fills or part fills with foam.

The method may comprise the following additional steps:

(e) after dispensing an initial purge quantity of foam into the syringe, causing the flow of foam from the source to cease;

(f) directing the said purge quantity of foam from the syringe into the dispensing device and out of the waste bleed outlet and/or further waste outlet;

(g) repeating steps (b) to (d) above.

Step (d) may be replaced by the step of dispensing foam to waste for a predetermined period of time or dispensing a predetermined mass or volume of foam to waste. Alternatively, this may be done and then additionally a check made as to whether the foam is of a predetermined acceptable quality.

The method may include a further step after the syringe has been filled in step (g) above, which is to leave the syringe in place for a period of time before removing it for use. The period of time may be 0.5 to 60 seconds, preferably 1 to 20 seconds, more preferably 2 to 10 seconds. This is done to allow the overpressure which will have built up in the syringe to equalize with the pressure of the surroundings. The syringe is open to the waste bleed outlet and a small quantity of foam will exit from the bleed outlet until the pressure has equalized.

During this process the valve, if there is one, may shift as the pressure reduces to allow foam to flow also out of the larger diameter waste outlet. This is explained in more detail below in the description of the first embodiment.

According to a second aspect of the invention, a device for dispensing foam comprises:

(a) a source of foam;

(b) an inlet in communication with the source of foam;

(c) a usable foam outlet;

(d) a waste outlet; and (e) a valve system connecting the inlet, usable foam outlet and waste outlet, wherein the valve has:

(i) a first state in which the inlet communicates via the valve system with the waste outlet, substantially to the exclusion of communication with the usable foam outlet;

(ii) a second state in which the inlet communicates with the usable foam outlet;

wherein during movement of the valve system between the first and second states, at no point is communication of the inlet with one or other of the usable foam and waste outlets shut off.

As with the first aspect of the invention, the first goal is to waste the initial flow of foam from the source which will be of inferior, inconsistent quality. This is achieved by having the valve system initially in the first state so that foam flows to waste. Once it is determined that the foam is of adequate consistent quality (either by observation or by dispensing foam for a predetermined time or dispensing a predetermined mass or volume of foam), the valve system is moved to the second state and flow is then directed to the usable foam outlet. During this transfer, the flow of foam continues through either or both of the waste and usable foam outlets, so that flow is never shut off.

As with the first aspect, a purge sequence may also be required to ensure that any air spaces in the syringe and/or dispensing device are filled with foam. There are a number of ways in which this could be achieved. One of these is to provide a third state of the valve system in which the usable foam outlet communicates with the waste outlet. Initially a quantity of foam is wasted (valve system in first state), then a syringe connected to the device is filled or part filled (valve system in second state), then generation of foam by the source is stopped. The valve system is moved into the third state and foam is ejected from the syringe into the device and out of the waste outlet. The valve is then returned to the first state and the sequence recommences as described in the previous paragraph.

Preferably, as with the first aspect of the invention, a waste foam container is provided as an integral part of the device and this container preferably has a transparent wall or portion of a wall to allow observation of the wasted foam so that the user can check when the foam is of sufficient consistent quality to be used. For example, the device may comprise a housing which defines the various outlets and which also defines the container or chamber for waste. As with the first aspect of the invention, the waste chamber may contain absorbent material.

The second aspect of the invention also encompasses a device as described above together with a syringe, either in assembled form or as a kit. If in kit form, the source of foam may be provided as a separate element of the kit. The source is preferably a pressurised canister containing gas and liquid, which may include a mixing element such as a small aperture or fine mesh through which gas and liquid pass in order to generate foam.

The second aspect of the invention also encompasses a device which does not include a source of foam but is adapted to be connected to or mounted on a source of foam such as a pressurised canister as described above. Such adaptation may be by means of formations which engage with complementary formations provided on the canister or other source of foam. Such an arrangement might be realised by supplying the dispensing device and canister (or other source) ready fitted with respective complementary parts of a connector device.

The invention also envisages a kit comprising a dispensing device and a source of foam such as a canister, with the canister and device being fitted with complementary connector devices. The source may comprise two canisters, a first containing liquid to be foamed and a second containing pressurised gas for charging the first canister prior to generation of foam. In this case the kit may comprise first and second canisters as described above, together with a dispensing device and, optionally, a syringe.

The second aspect of the invention also encompasses the sequences of method steps described above.

In particular, a method according to the second aspect of the invention for using the apparatus described above may comprise:

(a) initiating flow of foam from the source with the valve system in the first state;

(b) subsequently, switching the valve system to the second state to dispense a quantity of foam having predetermined acceptable and substantially consistent properties.

The initial quantity of foam which flows to waste while the valve system is in the first state may be between 0.25% and 50% of a volume of foam contained within or capable of being generated by the source. More preferably it is 0.5% to 20%, still more preferably 1% to 10%.

This method may include the further steps of:

(c) after dispensation of an initial purge quantity of acceptable, consistent quality foam with the valve system in the second state, switching the valve system to the third state and reintroducing the said purge quantity of foam into the dispensing device and thence out of the waste outlet;

(d) repeating steps (a) and (b) above.

Another method according to the second aspect of the invention comprises the steps of:

(a) if not already assembled, fitting a device as described above to a source of foam;

(b) fitting a syringe to the usable foam outlet of the device;

(c) initiating a flow of foam from the source with the valve system in the first state whereby an initial quantity of foam flows to waste;

(d) switching the valve system to the second state such that foam is dispensed into the syringe;

(e) switching the valve to the third state and directing the said initial quantity of foam to into the usable foam outlet and thence through the waste outlet;

(f) repeating steps (b) and (c) above but allowing the syringe to fill or substantially fill with foam for further use;

(g) returning the valve system to the third state for a period of time prior to removing the syringe, to allow pressure in the syringe to equalize with surrounding atmospheric pressure.

According to a third aspect of the invention, a device for dispensing foam comprises:

(a) a source of foam;

(b) an inlet in communication with the source of foam;

(c) a usable foam outlet;

(d) a waste outlet; and (e) a waste container in communication with the waste outlet;

wherein the waste container is forms an integral part of the device and has a transparent or translucent wall or wall portion to allow inspection of foam in the container.

The waste chamber may be packed with absorbent material for the purpose of absorbing some or all of the liquid component of any foam entering the chamber, and also for helping to break down the foam so that it occupies less volume. If absorbent material is used, the transparent or translucent wall portion may be omitted since inspection of the foam may not be possible.

The absorbent material may be any material which will readily soak up liquid, e.g. a paper based material or cotton wool or similar.

It will be appreciated that the features of the waste chamber in accordance with the third aspect of the invention may of course be applied to the first and second aspects of the invention described above.

Preferably, the bleed waste outlet (or both waste outlets) is directed towards an interior surface of the transparent or translucent wall or wall portion whereby, in use, foam exiting the outlet(s) impinges on the surface to facilitate observation of the foam. The arrangement is preferably such that the foam spreads out on the interior surface. Alternatively, if the chamber is packed with absorbent material, the bleed waste outlet is preferably directed at or into the absorbent material.

Preferably, the device comprises a housing which defines the various outlets and which also defines the container or chamber for waste. In an arrangement with two waste outlets, preferably both outlets communicate with the waste chamber.

The waste chamber preferably has a vent hole to allow pressure equalization with external atmosphere The third aspect of the invention also encompasses a device as described above together with a syringe, either in assembled form or as a kit. If in kit form, the source of foam may be provided as a separate element of the kit. The source is preferably a pressurised canister containing gas and liquid, which may include a mixing element such as a small aperture or fine mesh through which gas and liquid pass in order to generate foam.

The third aspect of the invention also encompasses a device which does not include a source of foam but is adapted to be connected to or mounted on a source of foam such as a pressurised canister as described above. Such adaptation may be by means of formations which engage with complementary formations provided on the canister or other source of foam. Such an arrangement might be realised by supplying the dispensing device and canister (or other source) ready fitted with respective complementary parts of a connector device. The invention thus envisages a kit comprising a dispensing device and a source of foam such as a canister, with the canister and device being fitted with complementary connector devices. The source may comprise two canisters, a first containing liquid to be foamed and a second containing pressurised gas for charging the first canister prior to generation of foam. In this case the kit may comprise first and second canisters as described above, together with a dispensing device and, optionally, a syringe.

A method according to any of the first to third aspects of the invention comprises the steps of:

(a) providing a device for dispensing foam and a source of foam connected to an inlet of the device;

(b) generating from the source of foam an initial quantity of foam and diverting this foam to waste through a waste outlet of the device;

(c) when the foam exiting the waste outlet has substantially consistent and acceptable predetermined properties, diverting a first portion of foam to a usable foam outlet, without any substantial interruption of the flow of foam from the source.

Additional steps of this method may be as follows:

(d) shutting off generation of foam after diverting a portion of the foam to the usable foam outlet;

(e) introducing the said first portion of foam back into the said device and thence out of the waste outlet, to purge air from the device;

(f) repeating steps (b) to (c) above;

(g) when the foam exiting the waste outlet has substantially consistent and acceptable predetermined properties, diverting a second portion of foam to a usable foam outlet.

Steps (c) or (g) may include visual or other inspection of the foam to determine when the foam has acceptable consistent properties. Alternatively or in addition, a predetermined mass or volume of foam may be dispensed to waste or foam may be dispensed to waste for a predetermined time, the volume, mass or time being such that consistent, acceptable quality foam is produced thereafter.

Preferably a syringe is provided and the method includes the step of attaching the syringe to the usable foam outlet of the device. Step (f) above is then performed by depressing the syringe plunger to force foam back through the device. Steps (e) to (g) also have the effect of purging air spaces in the syringe.

Preferably, the method comprises a final step of leaving the syringe in place for a period of time to allow pressure in the syringe to equalize with surrounding atmospheric pressure. It is normal for the internal pressure in the syringe to be of the order of 0.3 bar above atmosphere during filling and when filling has just finished. Once pressure is equalized, the syringe is then removed and the foam used. The period for pressure equalisation may amount to between 0.5 and 60 seconds, preferably 1 to 20 seconds, more preferably 2 to 10 seconds.

According to a fourth aspect of the invention, apparatus for dispensing foam comprises:

(a) a source of foam containing or capable of generating a predetermined quantity of foam;

(b) a foam-holding chamber having an upper and a lower end, and capable of containing a substantial proportion of the said predetermined quantity of foam;

(c) an inlet port communicating between the source of foam and the holding chamber; and (d) a usable foam outlet from the foam holding chamber, located in the region of the lower end of the chamber so as to permit egress of foam from below a surface of foam contained within the holding chamber.

Preferably the said usable foam outlet is located above the lower end of the chamber to prevent egress of any liquid which may drain from the foam.

A method according to the fourth aspect comprises the steps of:

(a) generating foam from a source and feeding this into a holding chamber;

(b) withdrawing foam from the holding chamber, from a point below the surface of the foam in the chamber.

Preferably, foam is withdrawn from above the level of any liquid in the chamber which has drained from the foam.

Preferably, the method comprises allowing the foam to remain substantially undisturbed in the holding chamber for a period of 1 to 120 seconds prior to withdrawing foam from the chamber. More preferably, this period would be 1 to 60 seconds, still more preferably 5 to 30 seconds.

The fourth aspect of the invention is particularly suitable where the foam is such that the buoyancy of larger bubbles will allow them to "cream" to the surface. This is the case for foams having relatively high densities, e.g. above 0.16 g/ml.

In a fifth aspect of the invention, apparatus for dispensing foam comprises a source of foam containing or capable of generating a predetermined volume of foam, together with a dispensing device, the device comprising:

(a) an inlet port in communication with the source of foam;

(b) a usable foam outlet;

(c) a waste outlet; and (d) a substantially enclosed waste container in communication with the waste outlet, the waste container having a smaller volume than the said volume of foam.

Preferably, the volume of the waste container is less than 50%, more preferably less than 25%, 15%, 10%, 5%, 4%, 3%, 2%, 1% or 0.5% of the said volume of foam.

Preferably, the volume of the waste container is such that it may be filled or substantially filled by a quantity of initially dispensed foam sufficient to ensure that foam of adequate, substantially consistent quality is produced thereafter. The container may be rigid, in which case it preferably has a small vent hole to atmosphere for equalising pressure as it fills. Alternatively, it may be flexible in which case it is preferably empty/airless in its starting condition.

The dispensing device may include a pressure-sensitive valve, e.g. a poppet valve, arranged to prevent flow of foam from the inlet to the usable foam outlet until a predetermined back pressure in the waste chamber is sensed, at which point flow from the inlet to the usable foam outlet is enabled.

Means may be provided for indicating to the user when the chamber is full or substantially full, particularly if the apparatus does not include a pressure-sensitive valve. Such means preferably comprise visual indicia. A flexible waste container may be incorporated inside a translucent housing, such that when the flexible container becomes full or nearly full, the container is pressed against the housing such that it becomes visible through the housing. The container is preferably coloured to enhance visibility.

A method according to the fifth aspect comprises:

(a) providing a device for dispensing foam and a source of foam connected to an inlet of the device, the device having a usable foam outlet and a waste outlet communicating with a waste chamber;

(b) with the usable foam outlet closed, generating foam from the source and diverting this foam to waste through the waste outlet and thence into the waste chamber until a predetermined back pressure in the waste chamber is sensed;

(c) when the said predetermined back pressure is sensed, by automatic or manual means, opening the usable foam outlet to allow continued flow of foam out of the usable foam outlet.

Practically, this method may involve a user keeping the plunger of the syringe fully depressed until back pressure from foam building up in the waste chamber is felt on the plunger, at which point the user releases the plunger. A possible disadvantage with this is that it may be possible inadvertently to shut off flow from the source by keeping the plunger depressed for too long. An alternative therefore is to have an automatic pressure sensitive valve which will open to allow foam to flow from the inlet to the usable foam outlet when a given back pressure is sensed. This may mean that the waste chamber is full of foam or that it contains foam and trapped gas such that a back pressure is created.

According to a sixth aspect of the invention, apparatus is provided for producing a syringe containing foam for further use, the apparatus comprising;

(a) a source of foam;

(b) a foam outlet nozzle in communication with the said source; and (c) a connector member encircling the said outlet nozzle and adapted to connect a syringe nozzle to the apparatus with the foam outlet nozzle extending into a bore of the syringe nozzle and with a gap remaining between an interior wall of the bore and the foam outlet nozzle.

Also according to the sixth aspect a kit is provided comprising this apparatus together with a syringe having a syringe nozzle.

Also according to the sixth aspect of the invention, a kit is provided for producing a syringe containing foam for further use, the kit comprising: (1) a syringe having a syringe nozzle and (2) a device for dispensing foam from a source of foam, the said device comprising:—

(a) an inlet for receiving foam from the source;

(b) a foam outlet nozzle in communication with the inlet;

(c) a connector structure for connecting the syringe to the device so that the foam outlet nozzle extends into the bore of the syringe nozzle;

wherein the syringe nozzle bore is of larger section than the section of the foam outlet nozzle such that, when the foam outlet nozzle extends within the syringe nozzle, a gap remains through which waste foam may exit.

Further features and advantages of the invention in its various aspects will be apparent from the following description of a number of specific embodiments, each of which embodies one or more aspects of the invention as defined above. The description is made with reference to the accompanying drawings, in which:—

A first embodiment of the invention, which comprises a method for generating foam, will now be described with reference to FIGS. 1*a* to 1*d*

Figure 1A:
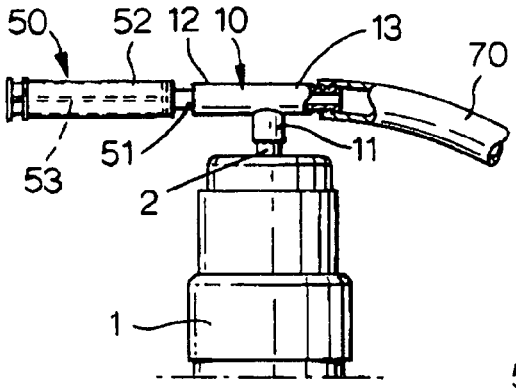
FIG. 1 is a diagrammatic representation of a first embodiment of the invention which is a sequence of method steps.

Referring firstly to FIG. 1*a*, a pressurized canister 1 is shown containing sclerosant solution. At the top of the canister is an outlet nozzle 2 connected to a valve (not shown) inside the canister which is actuated by depressing the nozzle 2.

A first limb (inlet) 11 of a three-way connector 10 is fitted to the nozzle so as to seal around the nozzle. A second limb (syringe outlet) 12 is formed as a female luer connector and the third limb (waste outlet) 13 is formed with a corrugated surface suitable for connection to resilient tubing.

A syringe 50 is connected via its luer nozzle 51 to the corresponding female luer connector on the second limb 12 of the three-way valve 10. The syringe 50 comprises a barrel 52 and a plunger 53, the plunger 53 being of a type which does not use lubricant since it has been found that lubricants can contaminate the foam.

A length 70 of standard, clear, flexible medical grade tubing is sealingly fitted over the end of the third limb 13 of the three-way connector 10 so as to deform resiliently against the corrugated surface and thereby form a seal.

Figure 1B:
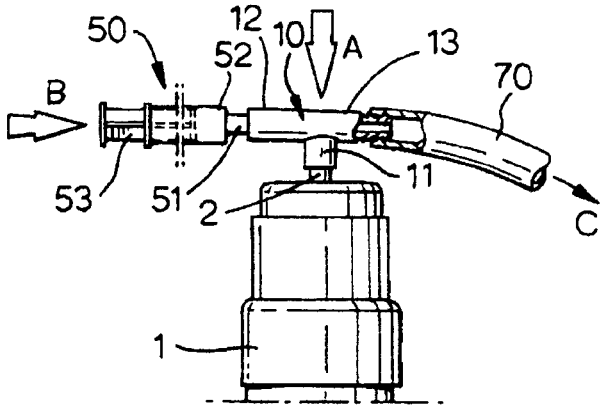

FIG. 1*b* shows the first step in the process of producing a syringe full of consistent quality foam suitable for injection into the varicosed vein of a patient. With one hand, a user presses down on the top of the three-way connector 10 (arrow A) thereby actuating the valve (not shown) in the canister to generate foam. At this stage the foam is not of sufficient quality or consistency to be injected into a patient, therefore with the other hand, the user holds the plunger 53 of the syringe in the fully depressed position (arrow B) to avoid foam entering the syringe barrel 52. The foam passes down the third limb 13 of the connector 10 and into the waste tube 70 (arrow C). The tube 70 may run to any suitable waste vessel (not shown).

Whilst foam is being generated and fed down the waste tube 70, the user monitors its properties by eye and makes a judgement as to when the foam passing down the tube is of consistently good quality. The main property of the foam which is being monitored is bubble size; large visible bubbles are an indication that the foam is of insufficient quality. The colour and texture of the foam can be observed and these give a good indication of quality. The user is also watching for wetness of the foam; if the foam appears to be mixed with liquid to any significant degree, this means the quality is not adequate. Other properties may also be monitored by means of visual observation of the foam, including density, stability, etc.

It is possible as an alternative to dispense foam to waste for a predetermined period of time or to dispense to waste a predetermined volume or mass of foam. If this is done, optionally a visual check of the foam could also be made prior to continuing with the procedure.

Figure 1C:
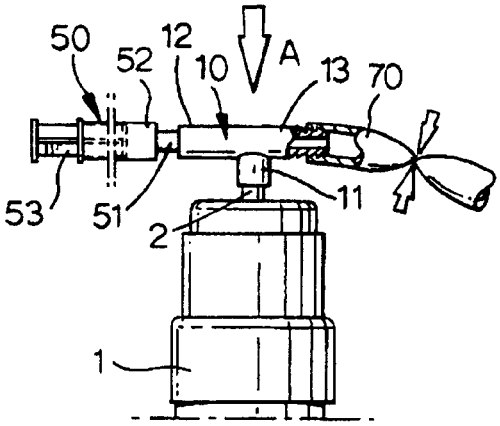

When the foam passing through the waste tube 70 has consistent acceptable properties, the next step is to block the waste tube 70 (see FIG. 1*c*). It can either be pinched between thumb and forefinger or a pinch valve (not shown) can be applied. At the same time or slightly beforehand, pressure on the plunger 53 is released, whilst the canister nozzle 2 and three-way connector 10 continue to be depressed. Foam from the canister is thereby directed into the barrel 52 of the syringe 50, with the plunger 53 being pushed back under the pressure of the foam.

The purpose of this step in the procedure is to remove air voids from the syringe, particularly the luer nozzle 51. It is found that only a small quantity of foam (5-10 cc usually) is required effectively to purge the syringe. Once sufficient has entered the syringe barrel 52 to push the plunger 53 back a little, the next step of the sequence may be performed. The movement of the plunger provides visual confirmation for the user that this step of the sequence is taking place, and indicates when the next step should be applied.

Figure 1D:
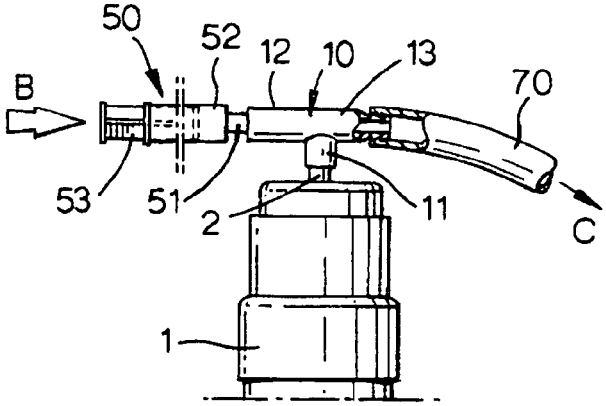

The next step is shown in FIG. 1*d*. The user releases canister nozzle 2 and three-way connector 10, thereby stopping the flow of foam from the canister. At this stage the syringe should have a small quantity of foam in it. The waste tube 70 is unblocked, either by releasing the thumb and forefinger grip or releasing a pinch valve (not shown). The syringe plunger 53 is depressed (arrow B) so that most of the foam in the syringe is expelled through the syringe luer nozzle, via the three-way connector, into the waste tube. Once the plunger has been fully depressed, the luer nozzle 51 and the second limb 12 of the three-way connector 10 remain filled with good quality foam. Air voids in the system have thus been removed.

Now that the air spaces in the syringe and three-way connector have been "purged" or filled with good quality foam instead of air, the sequence is repeated. The three-way valve is again depressed whilst the syringe plunger is held in and the waste tube is open. A small amount of foam is sent to waste until the quality of the foam is adequate, then the syringe plunger is released and the waste tube pinched to close it off. It is important that the waste tube is not pinched until pressure has been released from the syringe plunger. The syringe then fills up as the pressurised foam pushes back the plunger. When full, the downward pressure on the three-way connector is released and the waste tube opened. Foam ceases to flow from the generator. The syringe is left for a few seconds for any excess pressure in the syringe to be relieved by foam being exhausted from the waste outlet. Then the syringe is removed, the contents inspected briefly for voids and to check the quality of foam, and then it may be used.

The canister may contain sufficient solution for more than one syringe of whatever size is being used (normally 20 ml). In this case, the full syringe is detached and put to one side and a further syringe connected to the luer connector of the second limb 12 of the three-way connector 10. The process above is then repeated. Normally, two syringes may be filled from one canister. The canister, connector and waste tube are then discarded, and the full syringe or syringes used.

The foam will normally have a limited life of a few minutes, so this procedure would normally be done by a practitioner in his or her surgery immediately prior to injection of the foam. Particularly in view of this, it is important that these steps be carried out easily and reliably. The arrangement described above and shown schematically in FIG. 1 produces syringes filled with good, consistent quality foam. However, it is to some extent dependent on the skill of the operator in regard to the timing of the sequence of operations. It has been found that the system is vulnerable to any "dead spots" in the sequence, i.e. periods when there is no open outlet for foam. This would be caused if the syringe plunger 53 is held in at the same time as the waste tube is pinched off. The effect of this is the same as if the canister valve had been shut off: it is the same as starting the procedure from the beginning again. For the reasons described above, an initial quantity of poor quality foam will be produced.

Accordingly, when using the procedure described above it is important to synchronise the steps very precisely to minimize dead time. In fact, to solve this problem, the inventors have found that the best way to ensure that there are no dead spots is to actuate the pinch valve with the same hand that was used for holding the plunger 53 fully in, so that the flow is gradually diverted from one direction to the other, with the canister output never being shut off completely even for a brief moment. This further increases the level of skill required successfully to operate the apparatus described above.

Figure 2:
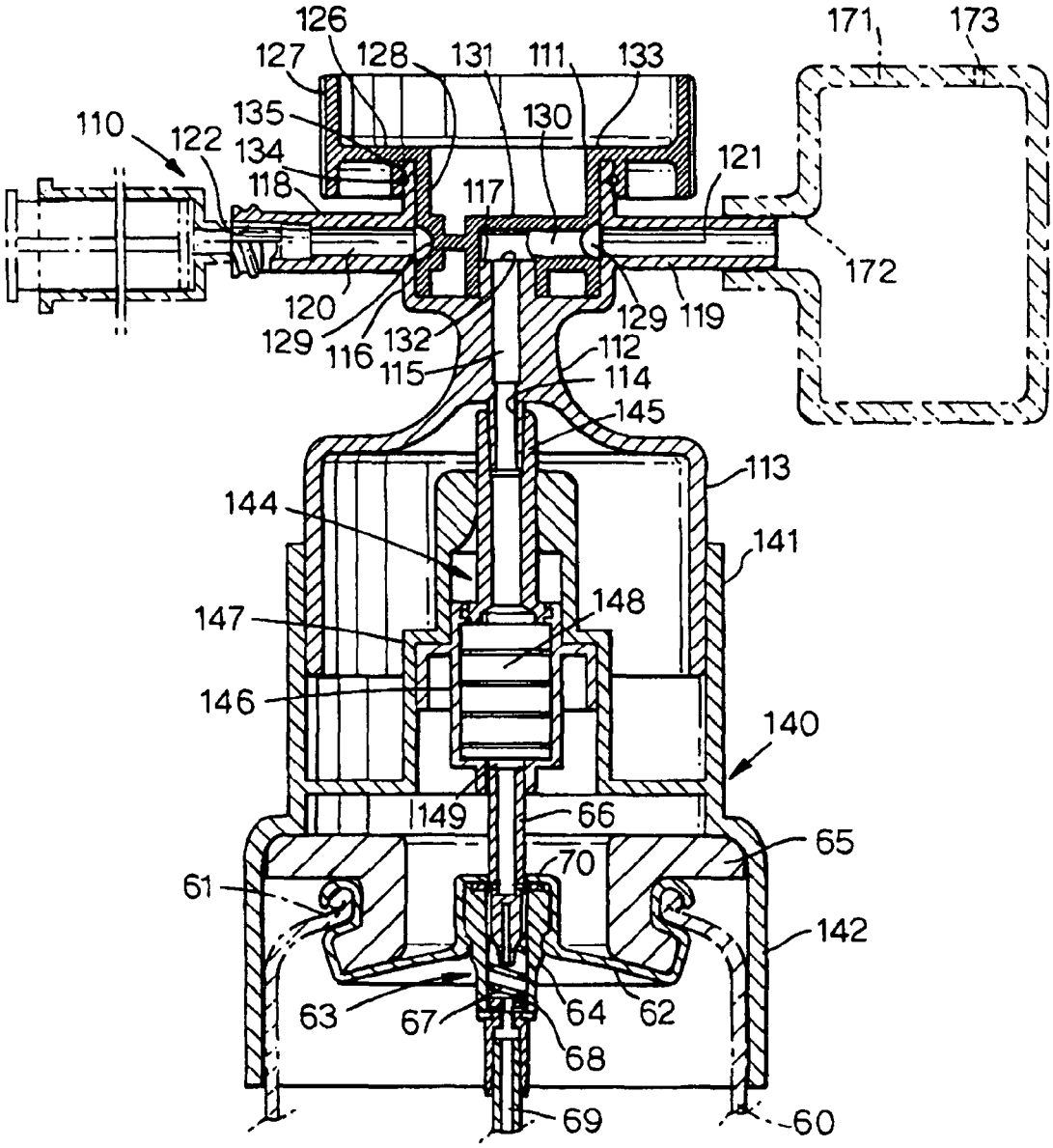
FIG. 2 is a sectional view of a dispensing device according to the second embodiment of the invention, together with the upper parts of a foam generating canister.

In order to reduce the level of skill required to obtain a consistent foam product, the inventors conceived the idea of using a three-way valve designed so as to have no "dead spots". Such a valve will now be described with reference to FIGS. 2 and 3. FIG. 2 in fact shows the second embodiment of the invention: a so-called "foam transfer device" comprising a three-way valve shown generally at 110 and a canister head unit shown generally at 140. The canister head unit houses a number of fine mesh elements for generating foam from the air and liquid mix dispensed by the canister valve. This canister head unit is normally permanently attached to the pressurized canister.

The three-way valve unit 110 consists essentially of two moulded plastics parts, a rotatable part 111 and a static part 112. The static part 112 comprises a depending cylindrical portion 113 which is slidably received in the upper part of the canister head unit 140 as will be described in more detail below. The cylindrical portion 113 is open at its base to receive a nozzle assembly upstanding from the canister head unit 140. On the underside of the cylindrical portion 113, depending from the central region thereof, is a connector spigot 114 adapted to engage within and seal with an upstanding nozzle of the canister head unit 140. Extending through the center of the spigot 114 and continuing up though the static part 112 is a bore 115. The upper part of the static portion 112 is moulded in the form of a cup 116, having a boss 117 upstanding from the centre of its base. The bore 115 extends through the boss 117 and opens upwardly.

Extending from each side of the cup 116 are connector limbs 118, 119 with respective through bores 120, 121 communicating with the interior of the cup 116. The first of these forms a female luer connector with an internal tapered bore 122 for receiving the luer nozzle of a syringe (not shown). The first connector limb is also formed with an external thread for engaging with the complementary internal thread formed on the sleeve around the luer nozzle of the syringe (not shown), depending on whether the syringe is provided with such a sleeve. Diametrically opposite the first connector limb, on the other side of the cup, is the second connector limb which, as shown, is adapted for receiving resilient medical grade tubing over it so as to seal with the interior surface of the tubing. Optionally, the second connector limb 119 could be provided with corrugations (not shown) on its exterior surface to assist in securing and sealing with the tube. As an alternative to waste tubing, a transparent waste container 171 (shown in dashed lines) could be provided to fit onto the second connector limb 119 by means of an appropriate female joint 172. The waste container is provided with a vent hole 173.

The rotatable part 111 of the three-way valve 110 takes the form of a disc shaped knob 126 with peripheral flange 127 with formations on its exterior surface to facilitate gripping and rotating by a user's hand. Depending from the lower surface of the disc-shaped knob is a cylindrical sealing flange 128 which engages against the interior surface of the cup 116 of the static portion 112 so as to seal against it. Extending circumferentially approximately half way around the exterior surface of the flange 128 is a channel 129 so positioned as to come into and out of registry with the proximal ends of the bores 120, 121 in the connector limbs 118, 119. At one point the channel 129 communicates with a radial bore 130 extending through a central boss 131 of the rotatable part 111. In the base of the boss 131 of the rotatable portion 111 is a circular aperture 132 which fits over and seals with the boss 117 of the static portion. In this way the bore 115 of the static part communicates with the radial bore 130 in the rotatable part.

At the top of the rotatable part is a detent flange 133 depending from the disc shaped knob 126, concentric with and exterior of the sealing flange 128. Several captive balls 134 are retained resiliently by the detent flange against the outer surface of the cup 116 of the static part 112. Formed in the outer surface of the cup 116 are detents 135, spaced circumferentially around the surface. As the knob 126 is turned, the balls 134 will click into place in the detents 135.

The canister head unit is shown generally at 140. The lower cylindrical portion of the three-way valve 110 fits within an upstanding cylindrical portion 141 of the canister head unit 140 in such a way as to be able to slide vertically within it. The lower half of the canister head unit comprises a skirt 142 which, in use, receives the top of the metal canister body 60 (shown in dashed lines).

A central support structure is provided as an integral part of the moulding of the head unit 140. In this support structure 147 a mesh stack unit 144 is slidably mounted. The unit 144 essentially consists of a nozzle 145 mounted in and extending out from a casing 146 which houses four mesh units 148. At the base of the mesh stack unit 144 is an inlet port 149.

Crimped into a rolled over edge 61 of an aperture in the top of the metal canister body 60 is a metal mounting cup 62. A valve unit shown generally at 63 is mounted in the valve support member 62, the mounting cup being crimped around the housing 64 of the valve. The valve 63 includes a nozzle member 66 whose upper end is received in the inlet port 149 of the mesh stack unit 144. The lower end of the nozzle member 66 is slidably received in the valve housing 64 and rests on a valve spring 67. In use, downward pressure on the nozzle 66 against the bias of the spring 67 causes the nozzle member 66 to deflect a sealing gasket 70 which encompasses the nozzle member 66. An aperture 71 in the side of the member 66 is thereby opened, causing the interior of the canister to communicate with the bore of the nozzle member 66.

Mounted to the base of the valve unit 63 is a dip tube 69 extending the full length of the canister body 60. A valve insert 68 is provided with close tolerance passages to allow a predetermined amount of gas from the canister head space into the liquid stream from the dip tube.

Also mounted in the mounting cup 62 is a mounting ring 65 to which the head unit 140 is attached. The head unit is secured to the metal body 60 by means of the mounting ring 65.

In use, generation of foam is commenced by the user exerting downward pressure on the top of the unit 110, which is transferred via the connector spigot 114, mesh stack nozzle 145, inlet port 149 to the valve nozzle member 66, against the bias of the valve spring 67, to open the valve nozzle member 66. Liquid and gas in predetermined proportions pass out of the valve nozzle 66 and through the mesh units 148 where the liquid and gas are combined into a fine foam, or microfoam.

As long as downward pressure is maintained by the user and sufficient liquid and gas pressure remain, foam continues to flow. The user controls whether the foam is directed to waste or to the usable foam outlet by rotating the knob 126. This will be further explained below with reference to FIG. 3.

Figure 3A:
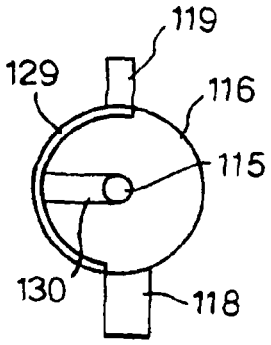
FIG. 3 is a diagrammatic representation of the rotary valve arrangement of the second embodiment.
Figure 3B:
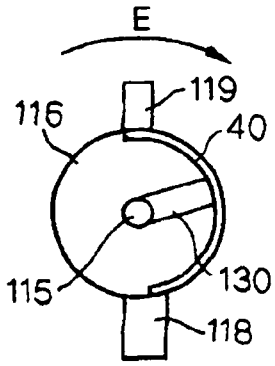
Figure 3C:
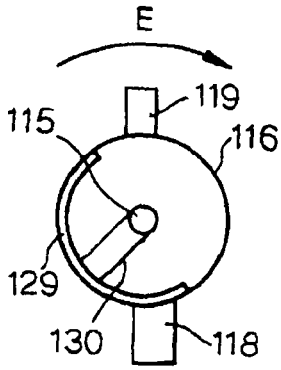

FIGS. 3*a* to 3*c* show in schematic plan view positions of the three-way valve 110 during a procedure to generate foam. The outer circle represents the cup member 116 of the static portion of the three-way valve 110, with the connector limbs 118 (syringe outlet) and 119 (waste outlet) shown leading from the cup 116. The channel 129 and radial bore 130 of the rotatable part 111 are shown within the cup 116. The central circle represents the bore 115 of the static part 112 of the three-way valve assembly 110.

FIG. 3*a* shows the position of the valve at the start. In this position the knob would be held in place by the balls 134 being resiliently held in the detents 135 in the outer surface of the cup 116 on which the knob 126 is mounted. The bore 115 of the static part 112 communicates via radial bore 130 and channel 129 in the rotatable part with the waste outlet 119 and thence either with a waste tube (not shown) or a waste container 171. The first step of the sequence described above in detail in connection with the first embodiment is thus carried out with the three-way valve in this position.

The user must make a determination of when the foam is of acceptable, consistent quality. This may be done either by inspecting the foam exiting through a waste tube or by inspecting the foam as it enters and is contained in the waste container 171. The second of these options is preferable since the properties of the foam are easier to observe in a container than when passing down a relatively thin tube. In the latter case, it may only be possible to make an adequate observation of the properties of the foam when it exits from the tube into a sink or open vessel on a workbench, or similar. Having a waste container 171 connected to the foam transfer device 20 means the path length from canister to waste inspection point is short, thereby minimizing wastage of foam. Furthermore the waste is contained without the need for additional vessels, etc to be provided. Once the whole unit is finished with, including canister and foam transfer device 20, including waste container 171, it can be disposed of as a single item with any waste foam stored within it. As previously stated, it is possible to rely on dispensing a predetermined quantity (volume or mass) of foam or dispensing foam to waste for a predetermined period to ensure that foam of adequate quality is being generated. It may still be desirable in this case to make a final visual check on foam quality.

It is found that the small vent 173, preferably in the upper surface of the waste container, is required to allow displaced air to escape when foam enters the container. Alternatively, the waste container could be made from flexible material and be in a collapsed or partially collapsed state initially.

When it is determined that adequate, consistent quality foam is being produced, the user grasps and rotates the knob 126 at the top of the foam transfer device 20, dislodging the balls 134 from their detents 135 by resiliently deforming the detent flange. As the knob is rotated, the balls 134 continue to be biased against the outer surface of the cup 116 as they move around with the knob 126. Once the knob has been turned around to the intermediate position shown in FIG. 3*b*, it can be seen that the channel 129 has started to open the syringe outlet or usable foam outlet 118, but the waste outlet 119 is still open: at no time has flow been shut off. This position corresponds to a second detent stop. While the valve is in this position, the user releases pressure on the syringe which is fitted to the syringe outlet 118. The syringe will start to fill, but foam will flow to waste as well. Once a small quantity of foam has entered the syringe, the user depresses the plunger and holds sit down, thereby expelling foam from the syringe, but leaving the nozzle and the syringe outlet 118 of the three-way valve "primed" with foam.

Pressure on the syringe plunger can then be released, allowing foam to fill the syringe. At this point, it is safe to rotate the valve further to the next detent position shown in FIG. 3*c*, since there is no danger of inadvertently blocking the syringe port by holding the plunger in for too long. Flow to waste is cut off, since it is desirable to have all the flow directed into the syringe.

As can be seen from FIG. 3*a*-3*c*, whilst the knob 126 is being turned though this sequence, one or both of the outlets 118, 119 is always open or partly open. Flow from the canister is never cut off; instead it is gradually diverted from the waste outlet to the syringe outlet. The only way of preventing the flow from the canister is to release downward pressure on the three-way valve, or to have the knob 126 in the position shown in FIG. 3*c* whilst keeping the syringe plunger held in. It is for this reason that the plunger should be released prior to or at least at the same time as turning the knob 126 to the position shown in FIG. 3*c*.

When the syringe is full, downward pressure on the three-way valve is released, thereby shutting off the flow.

A third embodiment is shown in FIGS. 4 to 10. This embodiment is somewhat more complex than the second, but requires a lower level of operator skill. A unit is fitted onto a pressurized canister such that the canister valve is permanently open. A valve arrangement with a six position dial on the unit allows the six stages of the procedure to be implemented simply by rotating the dial sequentially through the positions. The user is not required to hold down/release the syringe plunger at different points in the sequence. Only once in the sequence is the user required to do anything with the syringe, and that is simply to depress the plunger when the device is in the purge stage of the sequence. The device and its operation is described in detail below.

Figure 4:
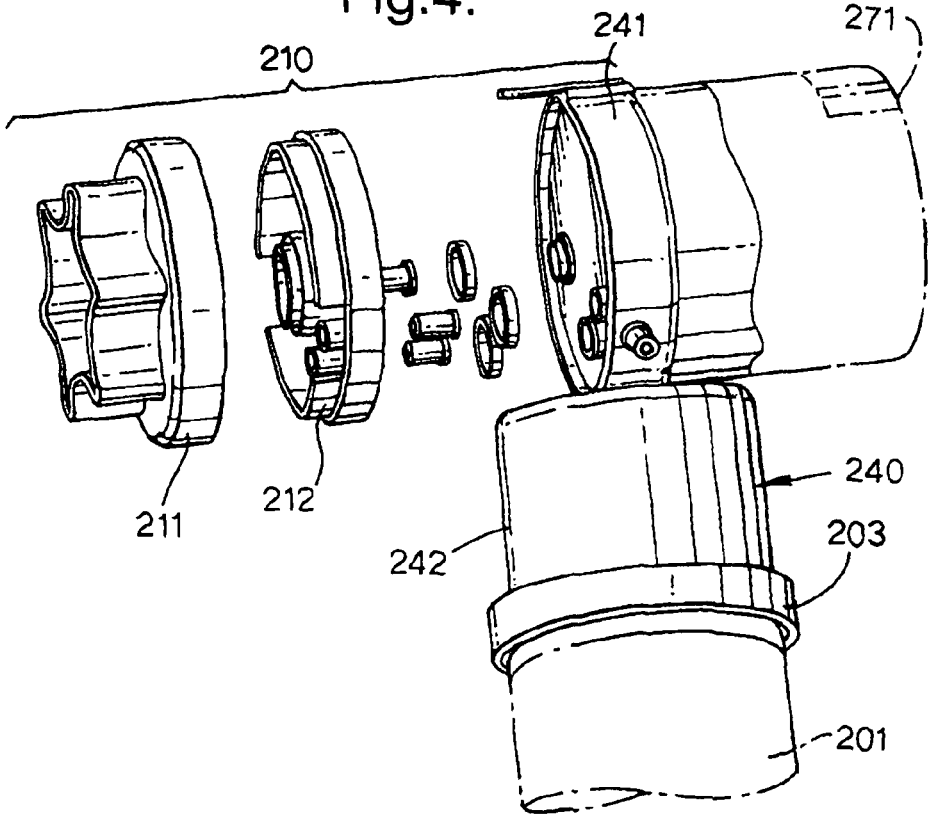
FIG. 4 is an exploded perspective view of a third embodiment.

Referring firstly to FIG. 4, the foam transfer device comprises a canister head unit 240 having an integrally moulded skirt region 242 and formed as an integral moulding with a valve base plate 241 which forms part of a three-way valve assembly shown generally at 210. The three-way valve assembly 210 comprises a valve plate 212 which fits onto the base plate 241 with various plungers and resilient discs sandwiched between them. These will be described in detail below. The final component of the three-way valve assembly 210 is a six position dial member 211 which fits onto the valve plate 212 so as to be rotatable thereon. On the opposite side of the base plate 241 is mounted a transparent waste container 271. The entire assembly if formed from a suitable plastics material such as ABS (acrylonitrile butadiene styrene), polycarbonate, high density polyethylene, polypropylene or acetal (polyoxymethylene). The waste container is formed from polypropylene, polycarbonate or PET (polyethylene terphthalate)

Figure 5:
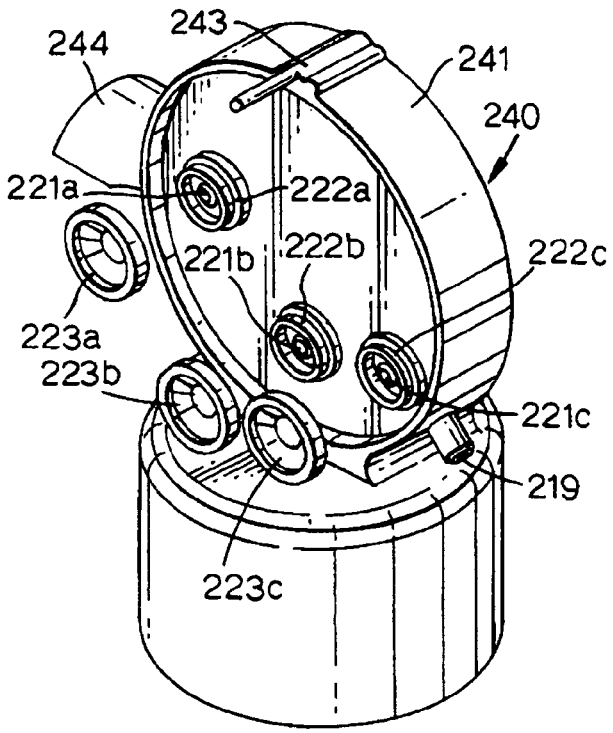
FIG. 5 is an exploded perspective view of part of the embodiment of FIG. 4.

In FIG. 5, the canister head unit 240 is shown in a little more detail. The base plate has three bores 221*a*-*c* surrounded respectively by pairs of concentric raised circular ridges which define between them grooves 222*a*-*c*. Resilient circular valve diaphragm discs 220*a*-*c* made, for example, of silicone rubber have peripheral flanges 223*a*-*c* which are received into these grooves 222*a*-*c* when the device is assembled. The bores 221*a*-*c* communicate, respectively, with a syringe port (not shown), and inlet port (not shown) and a waste port. The waste port is shown in FIGS. 4 and 5 in dashed lines as an external connector stub 219 to which a waste tube (not shown) may be connected which would lead to a separate waste vessel of some sort (not shown). The preferred arrangement, however, is for this port to communicate with the interior of the transparent waste chamber 271.

At the top of the base plate 241 a pointer 243 is formed. In the final assembly, the pointer 243 indicates the stage of the operation sequence with reference to indicia on the dial member. To one side of the base plate 241 is a syringe guide 244 extending partly around a syringe port (not shown).

Figure 6:
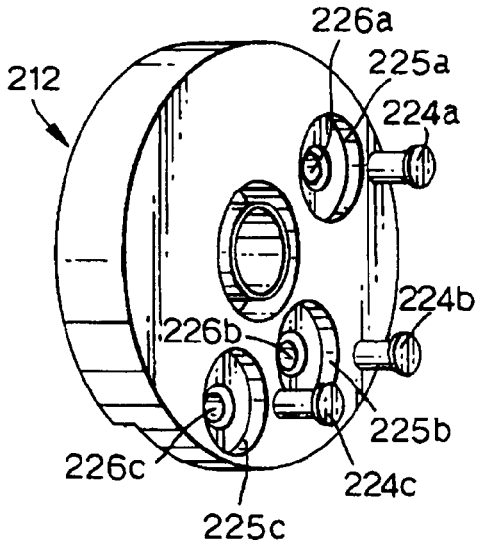
FIG. 6 is an exploded perspective view of another part of the embodiment of FIG. 4.

In FIG. 6, the valve plate is shown in more detail. On the "rear" face of the valve plate, which when assembled engages with the base plate, valve recesses 225*a*-*c* are formed into which the diaphragm discs 220*a-c* are respectively received when the valve plate is assembled to the base plate. Extending through the valve plate are plunger bores 226*a-c* in which are received, respectively, valve plungers 224*a-c*.

Figure 7:
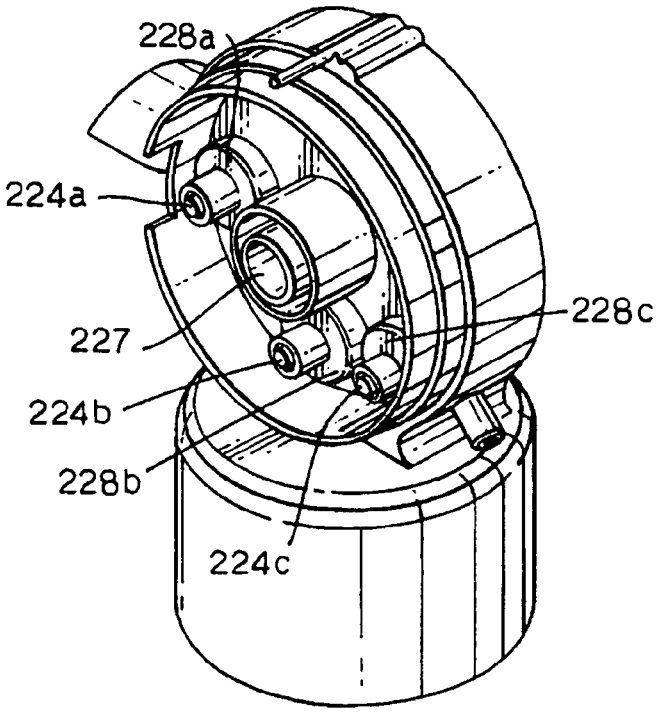
FIG. 7 is an perspective view of the parts shown in FIGS. 5 and 6 assembled together.

In FIG. 7, the valve plate 212 is shown assembled to the base plate 241; the "front" face of the valve plate 212 can be seen, i.e. the face which, when assembled, is engaged with the rotatable dial member 211. A central boss 227 extends from the face of the valve plate onto which, in the final assembly, the dial member 211 is mounted. Three formations 228*a-c* on the front surface of the plate correspond to the three recesses 225*a-c* on the rear surface of the plate. The formations 228*a-c* support the valve plungers 224*a-c*, the tips of which may be seen protruding from the formations 228*a-c* in FIG. 7.

Figure 8:
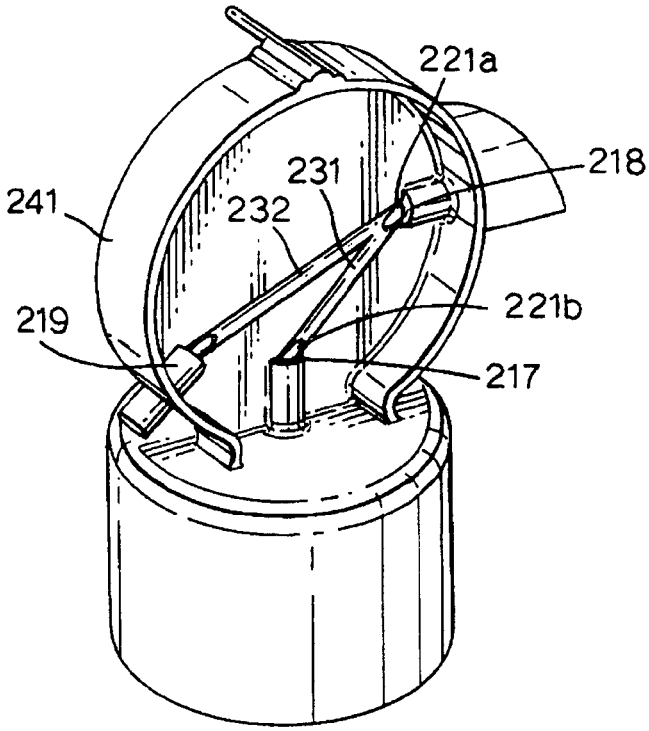
FIG. 8 is a perspective view from a different angle of the part shown in FIG. 5.
Figure 9:
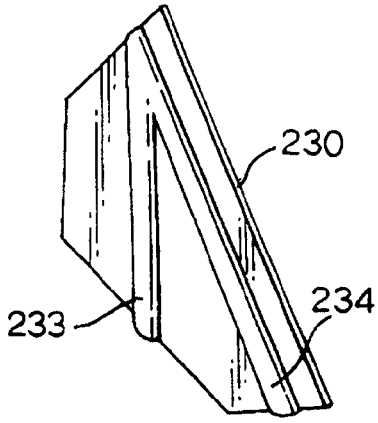
FIG. 9 is a perspective view of a further part of the embodiment of FIG. 4.

In FIG. 8 the rear face of the base plate 241 is shown. The bores 221*a-c* communicate with the syringe port 218, inlet port 217 and waste port 219. A back plate 230 is shown in FIG. 9 which fits sealingly over the exposed channels 231, 232 shown in FIG. 8. Channels 233 and 234 in the back plate 230 correspond to channels 231 and 232 in the rear of the base plate. As described above, in the preferred embodiment, the waste port communicates with the transparent waste container which would be mounted in the final assembly on the rear face of the base plate which is shown in FIG. 8. The arrangement is not shown, but it can easily be seen that the port 219 could be removed and an aperture provided in the channel 234 in the back plate which in the Figures leads to the waste port 219. Foam would then flow from the aperture directly into the vented waste container 271 which fits onto the rear face of the base plate.

The three diaphragm discs 220*a*, 220*b* and 220*c* open or close the syringe port (usable foam outlet) 218, foam inlet 217 and waste outlet 218 respectively. The diaphragms are depressed by their respective plungers to open the valves, or alternatively spring back to their relaxed (closed) state when no pressure is applied.

Figure 10:
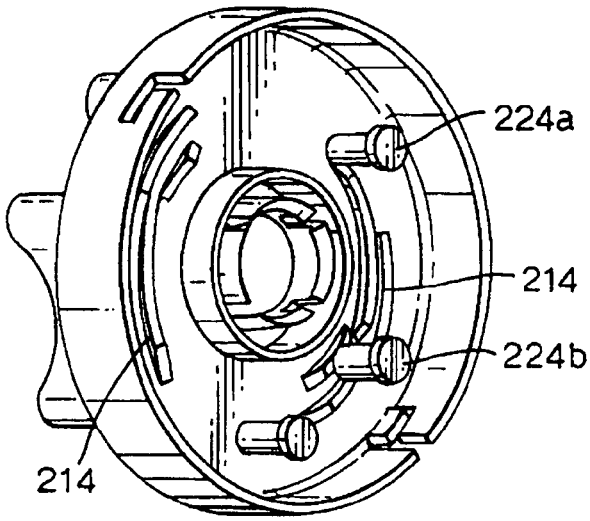
FIG. 10 is a perspective view of yet another part of the embodiment of FIG. 4.

FIG. 10 shows the rear face of the dial member 211. The plungers which in fact sit in the bores 226*a-c* in the valve plate 212 are shown in this figure to assist understanding of the valve system. On the rear face of the dial member 211, cam tracks 214 are formed. In the assembled structure, the tips of the plungers 224*a-c* come into and out of engagement with the cam tracks as the dial member is rotated, so that the plungers are either depressed against the bias of the respective diaphragms 220*a-c* or released to allow the diaphragms to spring back to their relaxed state. In this way, the various configurations of the valve system are achieved as the dial is turned.

The sequence of operation is summarised below.

Device is secured to canister after gassing operation (assuming a two can foam source)

Position 1: flow from canister shut off. Canister off; syringe on; waste on

Position 2: canister on; syringe off; waste on.

Position 3: canister on; syringe on; waste off

Position 4: canister off; waste on; syringe on

Position 5: canister on; syringe off; waste on

Position 6: canister on; waste off; syringe on

In a two canister arrangement, the canister containing liquid to be foamed is charged and then the dispensing device ("foam transfer device") is fitted. In a one canister arrangement, the device would be supplied fitted to the metal canister body. With the device fitted to the canister body, the canister valve is permanently open—there is no need for the user to depress the device to open the canister valve, as in the second embodiment. A syringe is fitted to the usable foam port or syringe port, but the user need not do anything with the plunger of the syringe, other than to depress it in the purge stage of the sequence at position 4.

The device starts off in position 1, where the inlet 217 is closed, preventing generation of foam by the canister. When the user is ready to start the foam generating process, he or she turns the dial to position 2 in which the inlet 217 is opened, as well as the waste outlet 219 allowing foam to flow to waste. The usable foam outlet 218 is closed.

After a predetermined period of time, and following a brief check by the user that the foam exiting the waste port is acceptable, the user turns the dial to position 3. The cam tracks on the dial member 211 are arranged such that the flow of foam does not cease, but gradually diverts from the waste outlet 219 to the usable foam outlet 218. Once a small quantity of foam has flowed into the syringe, the user turns the valve to position 4. Flow of foam is shut off. The user depresses the syringe plunger to purge the syringe of large bubbles and trapped air. Then the dial is turned to position 5 and a further quantity of foam wasted into the waste chamber 271. The dial is turned to position 6 and the syringe fills. Once the syringe is filled with acceptable foam, the dial is turned back to position 1 and the syringe removed, after a few seconds of pressure equilibriation time during which the excess pressure in the syringe vents to waste.

Figure 11:
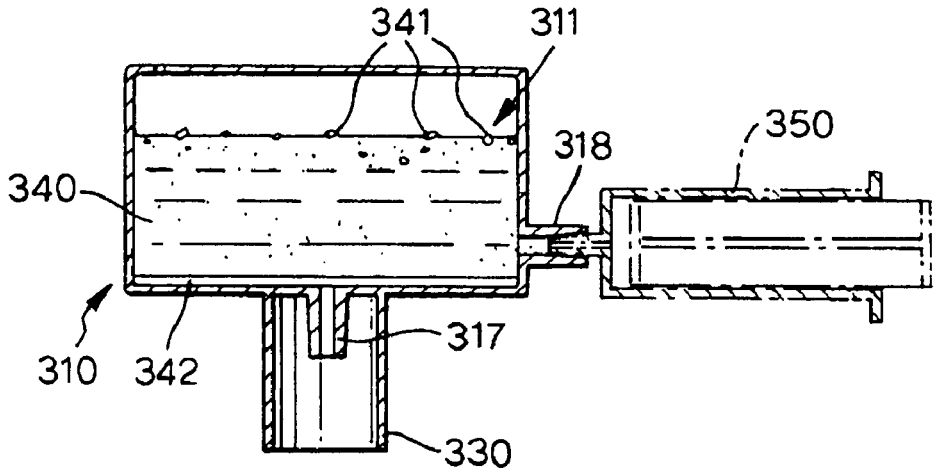
FIG. 11 is a sectional view of a fourth embodiment.

A fourth embodiment is shown in FIG. 11. This embodiment is in accordance with the fourth aspect of the invention as discussed above. Referring to FIG. 11 a device 310 for dispensing foam is shown. This device comprises a chamber 311 for holding foam, a usable foam outlet 318 located near the bottom of the chamber 311 and to one side, and a foam inlet 317. The device also includes means 330 for slidably mounting it on a canister, similar to the arrangement shown in FIG. 2, such that the inlet 317 engages with the nozzle of a canister in a similar way to the inlet 114 and canister nozzle 145 in FIG. 2.

Figure 18:
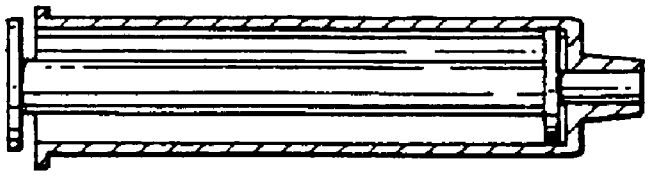
FIG. 18 is a sectional view of a syringe for use in connection with one or more of the embodiments.

In use, a syringe is first fitted to the usable foam outlet 318 (syringe 350 shown in dashed lines in FIG. 11), the user ensuring that the plunger is fully depressed. Downward pressure is then applied to the device to open the canister valve (not shown in this Figure—see FIG. 2) and commence generation of foam. A quantity of foam 340 in excess of that required for the desired application is continuously dispensed into the chamber 311. Downward pressure on the device is then released, the foam in the chamber allowed to remain undisturbed for a period of about 20 seconds. It is found that, depending on the overall properties of the foam, this allows larger bubbles created in the initial start up phase of foam generation in the canister to rise to the surface, as shown at 341. During the dwell period, liquid may drain from the foam, forming a thin layer 342 at the bottom of the chamber 311. For this reason the outlet 318 is located slightly above the bottom of the chamber, as shown in FIG. 11. Good quality foam, free from large bubbles and from liquid, is then withdrawn from the usable foam outlet 318 which is located beneath the surface of foam in the chamber. It may be desirable to use a syringe with minimal dead space, as shown in FIG. 18.

The fourth embodiment is particularly suitable for more dense foams, e.g. from 0.16 g/ml or 0.17 g/ml upwards. If the foam is less dense than this, the larger bubbles tend not to migrate to the surface fast enough.

Figure 12:
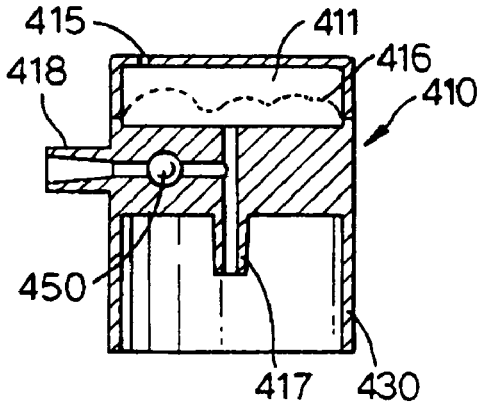
FIG. 12 is a sectional view of a fifth embodiment.

A fifth embodiment of the invention, which is in accordance with the fifth aspect of the invention discussed above, is shown in FIGS. 12 and 13. Referring firstly to FIG. 12, a foam dispensing device 410 is shown having a foam inlet 417 and a flange 430 for engaging with a corresponding feature of a canister (not shown) to locate the nozzle of the canister with the inlet 417 of the device and to allow relative sliding motion so that the device may be depressed to actuate the canister valve. The arrangement may be similar to that shown in FIG. 2 and discussed above in connection with the second and fourth embodiments.

The inlet 417 communicates with a waste chamber 411 which is of smaller proportions than the waste chambers of the other embodiments. The inlet 417 also communicates with a usable foam outlet 418 via a pressure sensitive valve 450. In the top wall of the chamber is a small vent hole 415.

In use, the device is fitted to the top of a foam-generating canister and a syringe is fitted to the usable foam outlet 418. Downward pressure is then applied to the device to actuate the canister valve; there is no need to keep the syringe plunger depressed. Foam flows into the chamber 411, with displaced air exiting through the vent hole 415. Once the chamber 411 is full or nearly full of foam, a back pressure is created since the vent hole is too small for foam to flow through at all or at least at any significant rate.

The back pressure causes the valve 450 to open, allowing foam to exit through the outlet 418 into the syringe.

In a modification of this embodiment, the valve 450 is omitted. In this case, in use, the user holds the plunger of the syringe down until the back pressure is sensed and then releases the plunger so that the syringe fills. The device may be fitted with some means for indicating that the chamber is full or nearly full, so that the user does not have to wait until back pressure is sensed on the syringe plunger. One way of doing this might be to make the walls of the chamber 411 of translucent material (for example a transparent material with its inner surface textured or roughened) and to incorporate a brightly coloured flexible membrane 416 into the chamber which will rise to contact the inner surface of the chamber when foam entering the chamber causes the membrane bag to swell. The membrane is shown in dashed lines in FIG. 12. The membrane would become visible once it is in contact with the interior of the upper wall of the chamber, providing a visual indication that the user should release pressure on the syringe.

Figure 13:
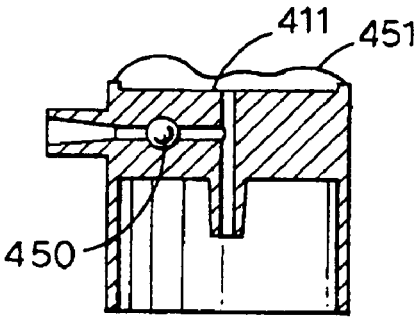
FIG. 13 is a sectional view of a modified version of the fifth embodiment.

A further modification of this embodiment is shown in FIG. 13. The wall of the chamber 411 is replaced with a flexible member 451 which in its initial state is collapsed. The chamber is thus inflated with foam until the flexible chamber wall is taught, at which point the valve 450 detects the back pressure and opens the outlet 418 to fill the syringe.

The fifth embodiment in its various forms may benefit from the use of a syringe with minimised dead space, as shown in FIG. 18.

Figure 14:
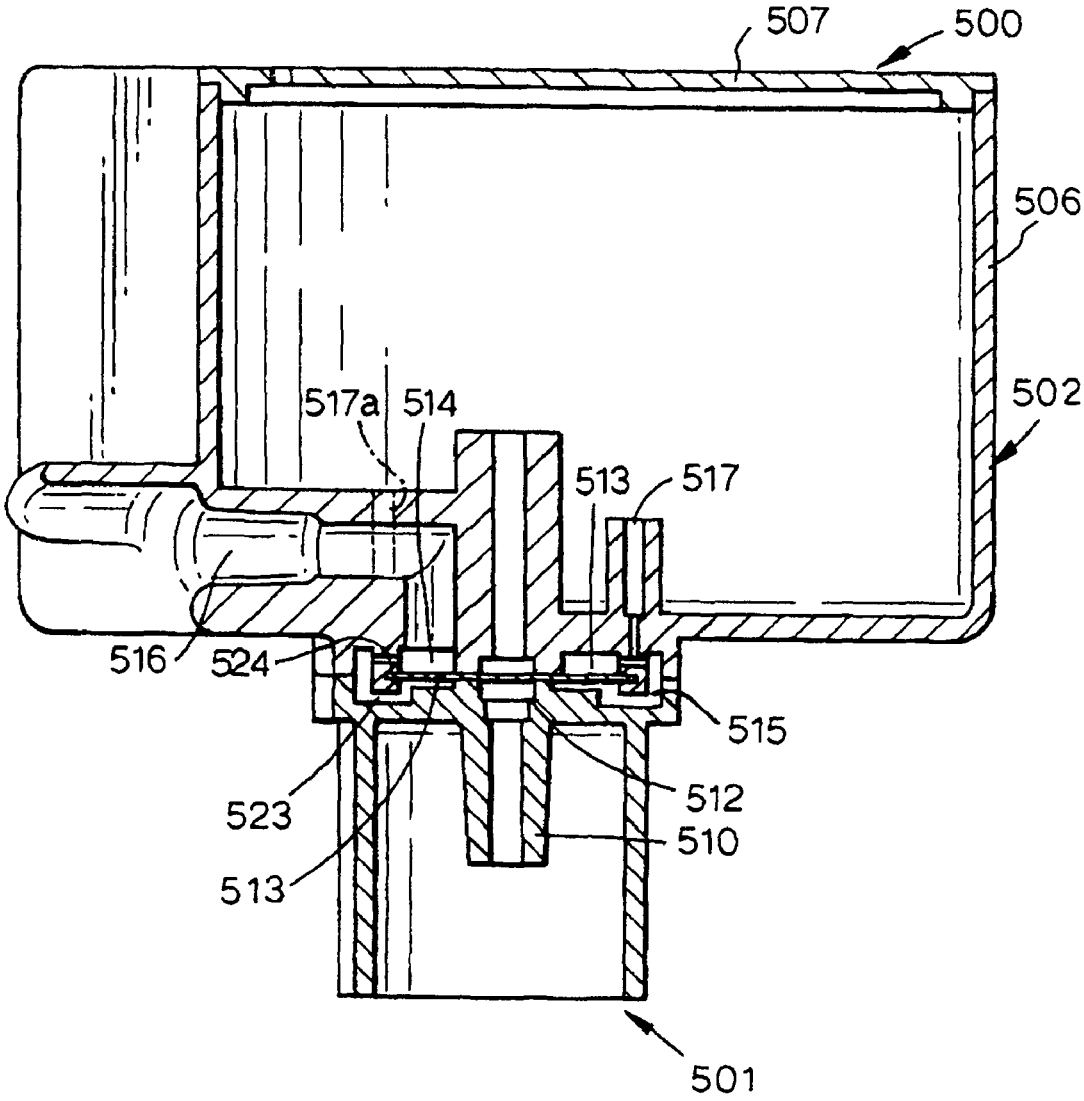
FIG. 14 is a sectional view of a sixth embodiment.
Figure 15:
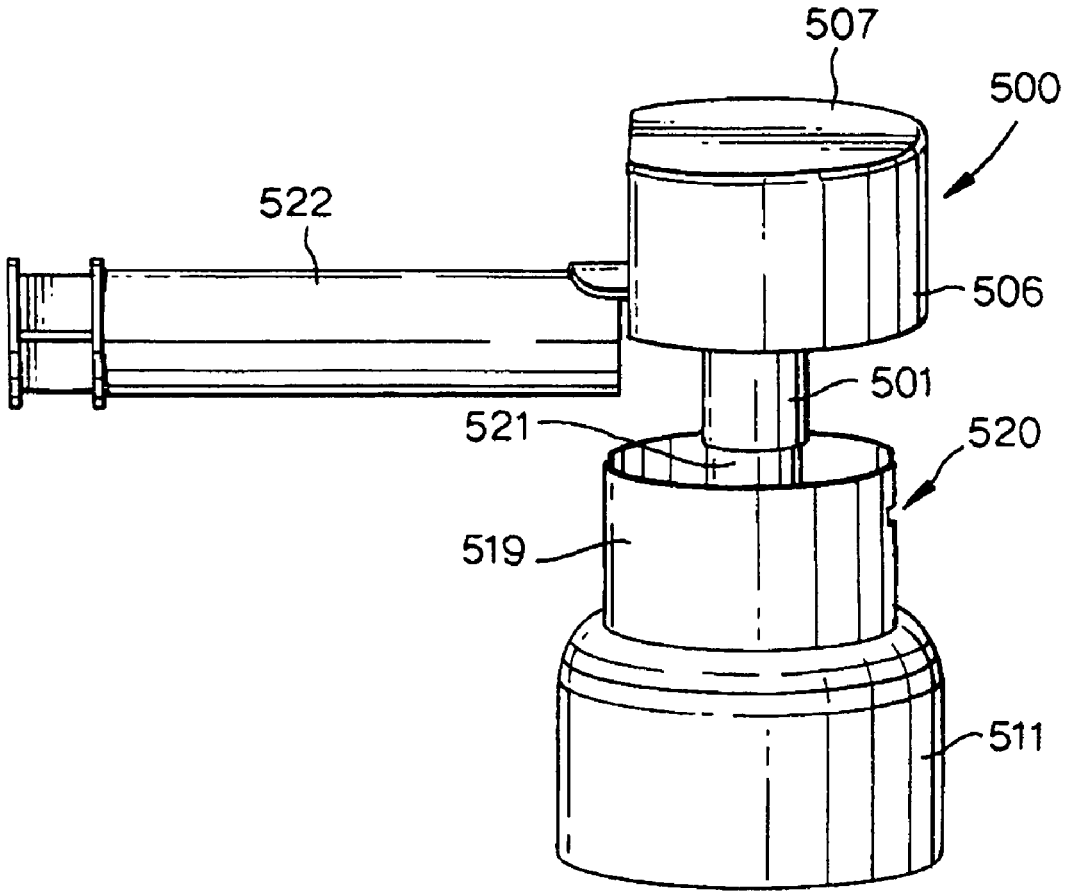
FIG. 15 is a perspective view of the sixth embodiment installed on a canister, with a syringe fitted.

A sixth embodiment is shown in FIGS. 14 and 15. The device 500 comprises a canister adapter unit 501 on which is mounted a valve body 502. The valve body incorporates the walls of a transparent waste container 506. The open top of the waste container 506 is closed off by a removable cover 507 in which is formed a vent hole 508.

The canister adapter 501 is a generally cylindrical body with an open base and a closed upper end. As with previous embodiments, a male luer connector 510 is provided within the cylinder, depending from the inside surface of the upper end member. In use the male luer 510 connects with a corresponding female luer (not shown) on a pressurized canister. On the outside surface of the end member of the adapter 501 is an annular valve seat 512 which surrounds the opening to the luer connector 510. Extending around the periphery of the adapter 501 are two adjacent concentric annular ridges.

In the assembled foam transfer device, the adapter is secured to the valve body 502 by suitable means such as ultrasonic welding or adhesive. The valve body 502 has a pair of concentric annular ridges complementary to those on the adapter. When the two components are assembled together (as shown in the figure), these ridges abut and clamp between them a silicone rubber diaphragm 513 whose purpose will be described in more detail below. The diaphragm 513 extends across a flat cylindrical chamber defined between the valve body 502 and adapter 501 which forms a valve chamber 514 with upper and lower parts defined respectively above and below the diaphragm 513. The concentric ridges on the valve body and adapter between them define the walls of an annular passage 515. A number of channels 523 extend radially under the inner of the two concentric ridges which upstand from the adapter, thereby providing communication between the lower part of the valve chamber 514 and the annular passage 515. Similarly, a number of slots 524 are formed in the inner of the two ridges on the valve body 502; in this way the upper part of the valve chamber 514 communicates with the annular passage 515.

The valve body 502 is formed with three outlets or ports. The first is a usable foam outlet or port 516 communicating with the upper part of the valve chamber 514. Communicating between the waste container 506 and the annular passage 515 (and thus with the valve chamber 514) is a small diameter waste bleed outlet or port 517. A second, larger diameter waste outlet or port 518 communicates between the waste container 506 and the valve chamber 514. The outer end portion of the usable foam outlet is formed as a female luer connector intended to receive the male luer nozzle of a standard syringe.

The dispensing device may be used with either a so called "one can" or a so called "two can" arrangement. In a two can arrangement, a first low pressure canister contains a liquid to be foamed and a second canister contains gas at high pressure. Prior to use, the first and second canisters are joined so that their respective nozzles communicate in a gas-tight manner and the first and second canister valves opened. The contents of the high pressure canister flow into the low pressure canister until the pressures in the two canisters are equalised. The canisters are then separated and the second canister discarded. This process is known as "gassing" the first canister. The two can arrangement may be used, for example, when the liquid to be dispensed as foam is sensitive to long term storage under pressure, or when the liquid is unstable when stored under the gas which is to be used to form the foam.

When used with a two can arrangement, the dispensing device is supplied as a separate unit to the canisters. Once the gassing process has been completed and the second canister discarded, the dispensing device is connected to the first canister, which is now ready for dispensing foam under pressure.

In a one can system, the dispensing device may of course be provided already mounted to the canister, or may even be wholly or partially incorporated in the canister. In the embodiment described below, however, the dispensing device is a separate unit which is adapted to be mounted to the canister containing a liquid to be foamed. In this case the liquid is a 1% solution of polidocanol which is to be combined with a mixture of carbon dioxide and oxygen into a foam for injection into varicose veins and similar arterio-venous malfomations.

FIG. 15 shows a canister 511 which contains 1% polidocanol solution and which has been gassed, and the high pressure canister removed. The canister originally contained polidocanol stored under carbon dioxide at about 1.2 bar, and the gassing canister contained pure oxygen at about 5.5 bar pressure. The gassed canister 511 contains a mixture of oxygen and carbon dioxide at about 3.5 bar.

Located on top of the canister 511 is a connector ring 519 which has cam tracks 520 extending around part of its periphery. The ring 519 and cam track 520 are part of a connector arrangement for attaching the canister 511 to the high pressure canister (not shown) during storage and in the gassing process. The second, high pressure canister is fitted with a complementary connector device (not shown) comprising a ring with two cam follower pins formed in its inner diameter which engage and lock in the cam track 520. To perform the gassing operation, the second canister is rotated with respect to the first canister, the boss/cam travelling along the cam track 520 until it comes to a detent. This operation forces the canisters together and depresses their respective nozzles so that the interiors of the canisters communicate. Once gassing has finished, the second canister is rotated further with respect to the first canister, past the detent position, to a point where the canisters are moved apart so that their respective valves are shut off, and then further to a point where the cam followers emerge from the cam track so that the canisters can be separated and the second canister discarded. The connector ring 519 serves no further purpose in this embodiment; though it is envisaged that in a modification of this embodiment it may be used to secure the foam dispensing device 500 to the gassed canister 511.

The canister 511 incorporates one or more fine meshes (not shown) through which the polidocanol and gas mixture pass to create foam. When the canister nozzle (not shown) is depressed, liquid is forced under pressure up a dip tube (not shown) inside the canister. Near the top are apertures (not shown) into which gas is drawn by a venturi effect, so that a mixture of gas and liquid enters the mesh to be made into foam. It takes a brief moment for the flow to settle to a constant ratio of gas to air; in this particular embodiment this period is very short—of the order of half a second. During this start up period the foam generated is not consistent. If the pressure on the canister nozzle is released so that flow stops, the liquid level in the dip tube rapidly drops, which means that when flow is commenced again there will be the same brief start up period during which inconsistent foam is produced.

The sequence of operation is as follows.

1. First the polidocanol (first) canister is gassed and the oxygen (second) canister removed.

2. The foam dispensing device 500 is then fitted to the nozzle of the polidocanol canister 511. The canister adapter 501 of the dispensing device is fitted over a connector hub 521 on the polidocanol canister (see FIG. 15) so that the canister nozzle (not shown) engages with the luer connector 510 of the dispensing device to form a gas tight seal. The arrangement allows relative sliding between the adapter 501 and hub 521, so that the entire dispensing device 500 may be pressed down to depress the nozzle of the canister and thereby open the canister valve.

3. A syringe 522 is fitted to the usable foam outlet 516 of the dispensing device and the plunger of the syringe 522 is maintained in a fully depressed position.

4. The dispensing device 500 is depressed so that the canister valve is opened and flow of foam commences. This causes foam to flow from the canister, into the dispensing device via the luer connector 510 and into the lower half of the valve chamber 514. The valve diaphragm 513 is urged upwards by the pressure of foam entering the chamber 514, which prevents flow of foam through the large diameter second waste outlet 518. The foam cannot flow out of the usable foam outlet 516 because the syringe 522 is blocking this outlet. The foam is able to flow out of the waste bleed outlet 517, which is does. Foam emerging from the waste bleed outlet enters the waste container 506.

5. The next step is to determine when the foam is consistently of sufficient quality for use. This may be done by observing the foam in the container 506 though the transparent cover 507. In this embodiment it is expected that the foam will be a consistent, homogeneous foam within one second, and an option for the user is simply to dispense foam into the waste container for approximately one second and then assume that the foam is of acceptable quality. In practice, a combination of these is adopted: the user plans to dispense foam for a second or so, but will observe the foam as well to ensure there is no problem with it.

6. The next step is to release the syringe plunger, whilst continuing to depress the dispensing device. Foam may now flow through the usable foam outlet and into the syringe. A certain amount of resistance to flow of foam will be offered by the bore of the syringe nozzle (in this case a standard luer nozzle) and the passage usable foam outlet (that term being understood to include the passage leading from the valve chamber to the syringe nozzle). Further resistance will be offered by the syringe plunger as it is pushed back by foam entering the syringe. The dimensions of the waste bleed outlet 517 are designed with this in mind so that the resistance to flow offered by the bleed outlet is higher than the resistance encountered by the foam entering the syringe. Therefore, although foam will continue to flow into the waste chamber during this stage of the procedure, that flow will be considerably smaller than the flow into the syringe. It is of course desirable to minimise waste. In practice the dimensions of the waste bleed outlet 517 will be a compromise between minimising waste of foam, minimising the duration of the start up period before foam of acceptable quality is produced, and providing sufficient flow through the bleed port to prevent the device from "stuttering" and producing out of spec. foam after the initial purge to waste.

7. Once a quantity of good quality foam has been introduced into the syringe, the pressure on the dispensing device is released thereby shutting off flow from the polidocanol canister 511. The syringe will then contain good quality foam, but also a bubble of air and/or poor foam caused by the dead air space in the usable foam outlet and syringe nozzle being pushed into the syringe by flow of foam. This air bubble or region of poor foam will normally be located adjacent the syringe plunger; therefore one option is for the user is to avoid fully emptying the syringe when using the foam, thus avoiding the injection of poor quality foam. The dead space can be minimised by using a design of syringe with virtually zero dead space, in which the plunger incorporates a projection which fills the nozzle (see FIG. 18). Furthermore, the waste bleed passage can be placed as near to the syringe nozzle in the usable foam outlet as possible (see 517*a* in FIG. 14), thereby minimising dead space in the dispensing device. By these means, the quantity of air/poor foam entering the syringe can be reduced to substantially zero.

8. As an alternative, further steps may be added to the sequence set out above to eliminate dead air space by flushing the dispensing device with good quality foam. In this case, in step 7 above only a small quantity of foam is allowed to enter the syringe before the flow of foam from the canister is stopped. The syringe plunger is then depressed to drive foam back out of the syringe, through the usable foam outlet and into the upper part of the valve chamber 514. With foam pressure being applied to the upper surface of the valve diaphragm 513, the second waste outlet 518 becomes open and foam flows through it. Foam will also flow through the waste bleed outlet 517/517*a* whether it is positioned adjacent the usable foam outlet or not.

9. Once all the foam in the syringe has been emptied into the foam dispensing device, the air spaces in the device, in particular those in the flow path from canister to syringe, will have been filled with foam of acceptable quality. Steps 3 to 7 of the above sequence are then recommenced: the syringe plunger is held in whilst the canister valve is opened again to cause foam to flow through the waste bleed outlet 517/517*a*.

10. After a brief period, as discussed under step 5 above, the syringe plunger is released to allow foam to the enter the syringe and fill the syringe. No air bubble should be present in the syringe because the dead spaces in the dispensing device have been filled with foam.

11. Once the syringe is full, the canister valve is shut off.

12. Optionally, before removing the syringe full of foam, a brief period of time (e.g. 5 seconds) is allowed to elapse. This is to ensure that pressure in the syringe etc has equalised to the pressure of the surroundings; a small overpressure will have been created in the syringe and passages leading to it, and this pause after closing the canister valve allows the pressure to be relieved—in practice a small volume of foam will exit the waste bleed outlet to relieve the pressure. During this brief period, the diaphragm 513 is initially biased upwards. The diaphragm is pretensioned so that it is biased against the lower valve seat 512. As the pressure reduces, the pretension in the diaphragm overcomes the pressure differential and it moves downwards, thus opening the pathway from the usable foam outlet to the second waste outlet 518. Foam then flows at a faster rate through both the bleed outlet and the second waste outlet.

13. The syringe is then removed ready for use.

Figure 16:
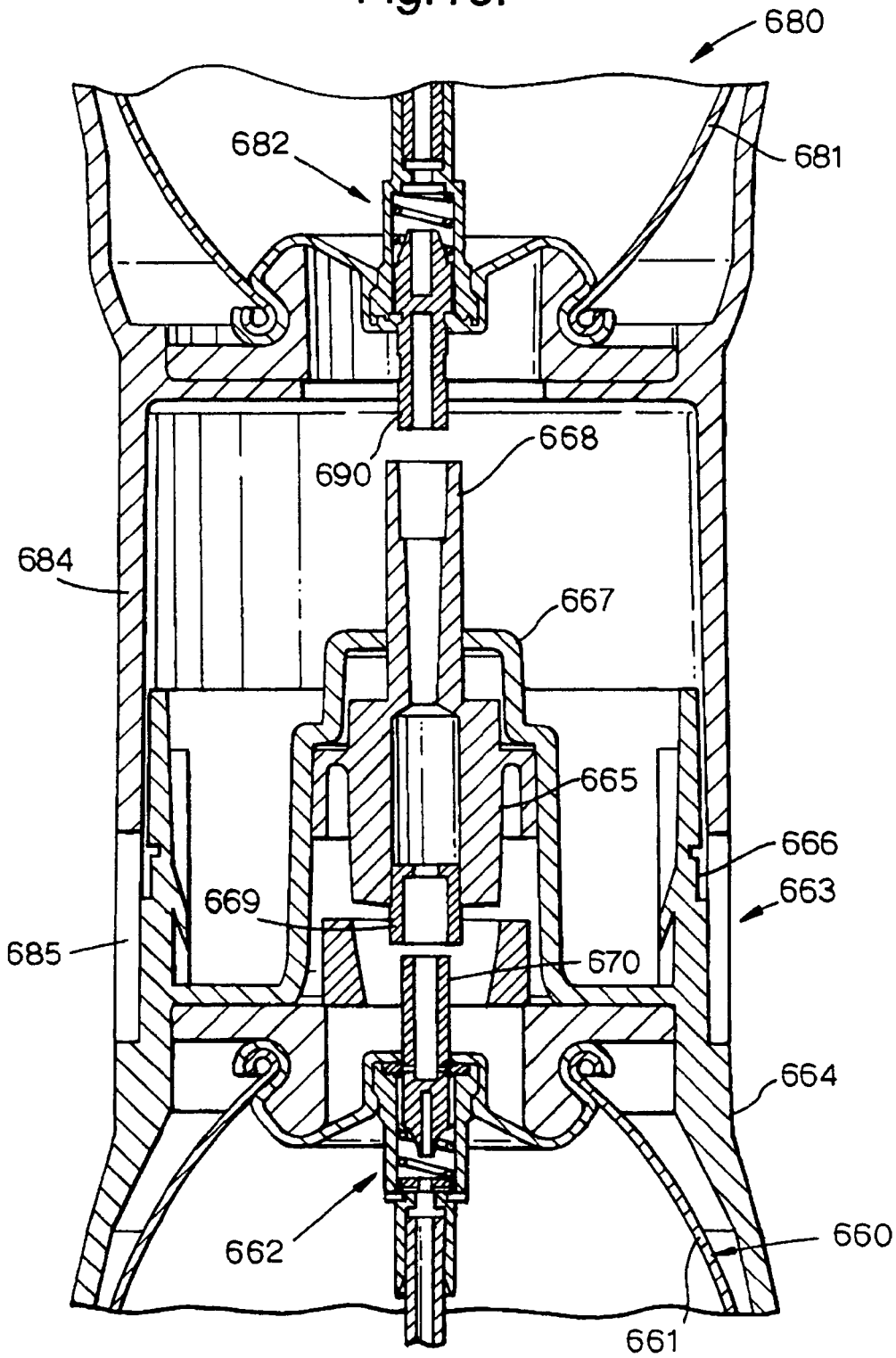
FIG. 16 is a sectional view of a two-canister assembly, in connection with a seventh embodiment.
Figure 17:
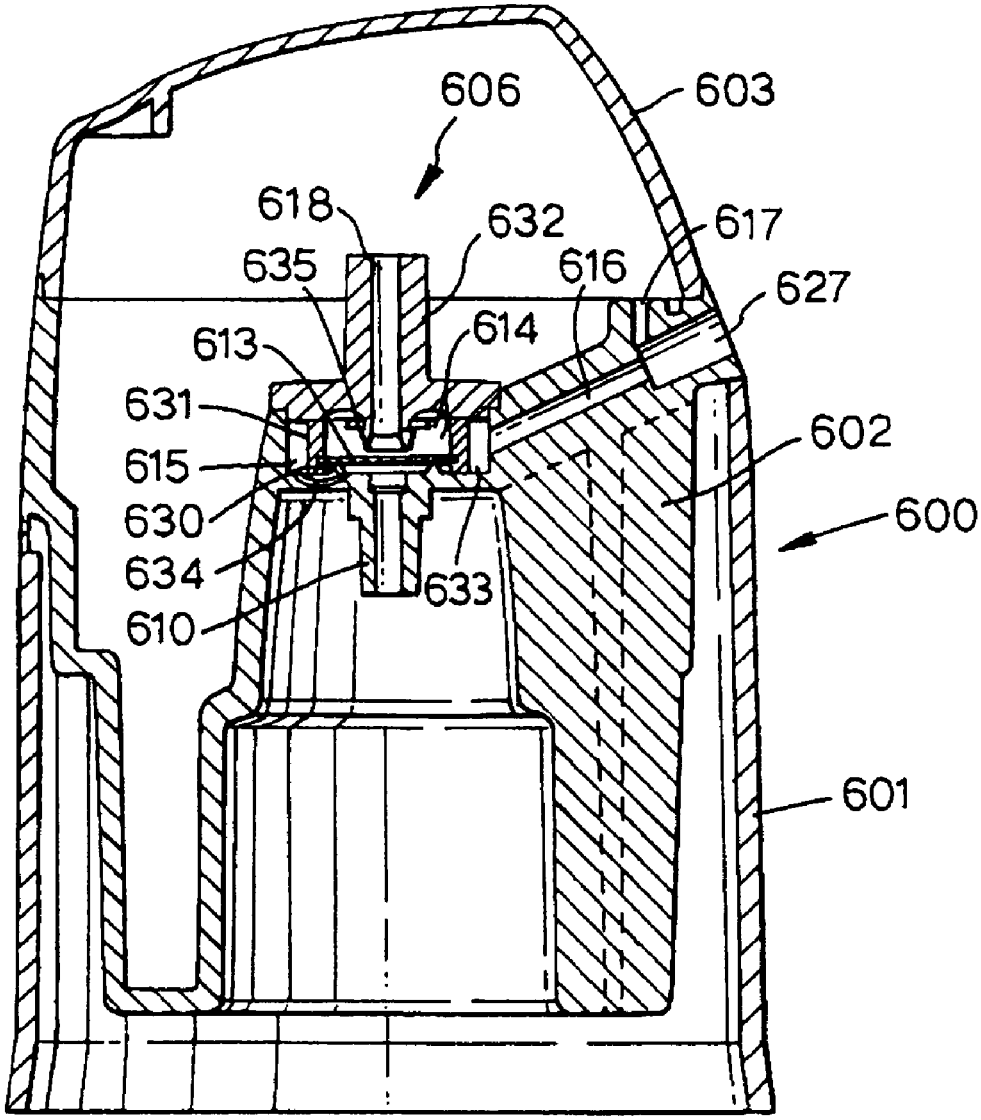
FIG. 17 is a further sectional view of the seventh embodiment.

FIGS. 16 and 17 show a seventh embodiment whose operation is in many respects the same as the sixth; the seventh embodiment is a two can system.

Referring first to FIG. 16, a two can system is shown in its initial state, with a polidocanol canister 660 assembled to an oxygen canister 680. The polidocanol canister 660 comprises a metal vessel 661 in which a valve unit 662 is installed; the valve unit has a nozzle 670.

Mounted to the top of the metal vessel 661 is a polidocanol canister collar 663 comprising a moulded plastics housing 664 which is formed with an upstanding central boss 667 in which a mesh stack unit 665 is slidably received. The mesh stack unit 665 includes a nozzle 668 which protrudes through an aperture in the end of the boss 667. The lower end of the mesh stack unit 665 is formed with an inlet 669. The exterior of the housing 664 is formed with a cam track 666.

Received over the top of the housing 664 is an oxygen canister collar 684 which forms part of the oxygen canister 680, and is mounted to a metal vessel 681, in a similar manner to the polidocanol canister 660. A cam follower (not shown) engages with a part of the cam track 666 which is not shown in FIG. 16. As with the polidocanol canister 660, a valve unit 682 is fitted to the end of the metal vessel 681; the valve 682 has a nozzle 690.

In the condition shown in FIG. 16, the oxygen canister collar 684 rests against a safety clip 685 which prevents the two canisters 660, 680 from being moved towards each other. The safety clip covers approximately 75% of the circumference in the region between the polidocanol canister and oxygen canister collars. It is made from resilient material and can be removed by hand.

In use, the safety clip 685 is removed and discarded and then the two canisters are rotated relative to each other. This causes the cam followers on the oxygen canister collar to move in the cam track 666, moving the two canisters towards each other. As this happens, the valve nozzle 690 of the oxygen canister engages in the nozzle 668 of the mesh stack unit 665, and the valve nozzle 670 of the polidocanol canister engages in the inlet 669 of the mesh stack unit. Further rotation of the canisters brings them closer together which results in depression of the valve units 662, 682 in the polidocanol and oxygen canisters respectively and thus opening of the valves. At this point the cam follower of the oxygen canister collar encounters a detent (not shown) in the cam track 666.

When the user feels the detent, he stops rotating the canisters relative to each other. With the two valves 662 and 682 open, the pressures in the canisters equalise; this process takes less than a minute and is audible. Once the process has finished, the user continues to rotate the two canisters, so that the cam follower moves past the detent and causes the canisters to move apart so that the valves 662, 682 are shut off. Continued rotation causes the cam follower to emerge from the end of the cam track so that the canisters can be separated. The oxygen canister is then discarded.

Turning now to FIG. 17, a foam dispensing device 600 is shown. A valve body moulding 602 includes an extended base which fits inside the polidocanol canister collar 664 (See FIG. 16). A cosmetic skirt 601 is mounted to and extends around the main valve body moulding 602. Permanently fitted to the top of the moulding 602 is a moulded cap member 603 of transparent plastics material.

The valve body 602 is adapted to fit over the central boss 667 of the polidocanol canister collar 664, with the nozzle 668 engaged around a depending male luer connector 610 on the valve body 602. The dispensing device is supported on the polidocanol canister by the engagement between the nozzles 610, 668 and is restrained against lateral movement by the engagement between the body 602 and the polidocanol canister collar 664. The arrangement is such that the dispensing device may be manually pressed downwards, such that the valve 662 of the polidocanol canister is pressed down and opened (See FIG. 16).

A valve lid unit 632 is provided which has an annular ridge 630 depending from its underside. A corresponding upstanding annular ridge 631 is provided on an upper surface 633 of the body 602 and a valve diaphragm 613 is clamped between the two annular ridges 630, 631. The upper ridge 631 has apertures 635 in it through which a valve chamber 614 defined within the ridges communicates with an annular passage 615 extending around the outside of the ridges. A number of channels 634 are formed in the surface 633 which extend beneath the lower clamp ridge 630 and communicate between the lower portion of the valve chamber 614 beneath the diaphragm member and the annular passage 615.

The valve body 602 defines a usable foam outlet 616 terminating in a female luer connector 627. The outlet 616 communicates with the annular passage 615. At the interface between the usable foam outlet 616 and the luer connector 627 is a waste bleed outlet 617. The waste bleed outlet 617 is a small bore passage which communicates between with a waste container 606 defined by the valve body 602, cap member 603 and valve lid unit 632. A further, larger bore waste outlet 618 is defined within the lid unit 632.

The use of the seventh embodiment is exactly analogous to that of the sixth embodiment.

Figure 19:
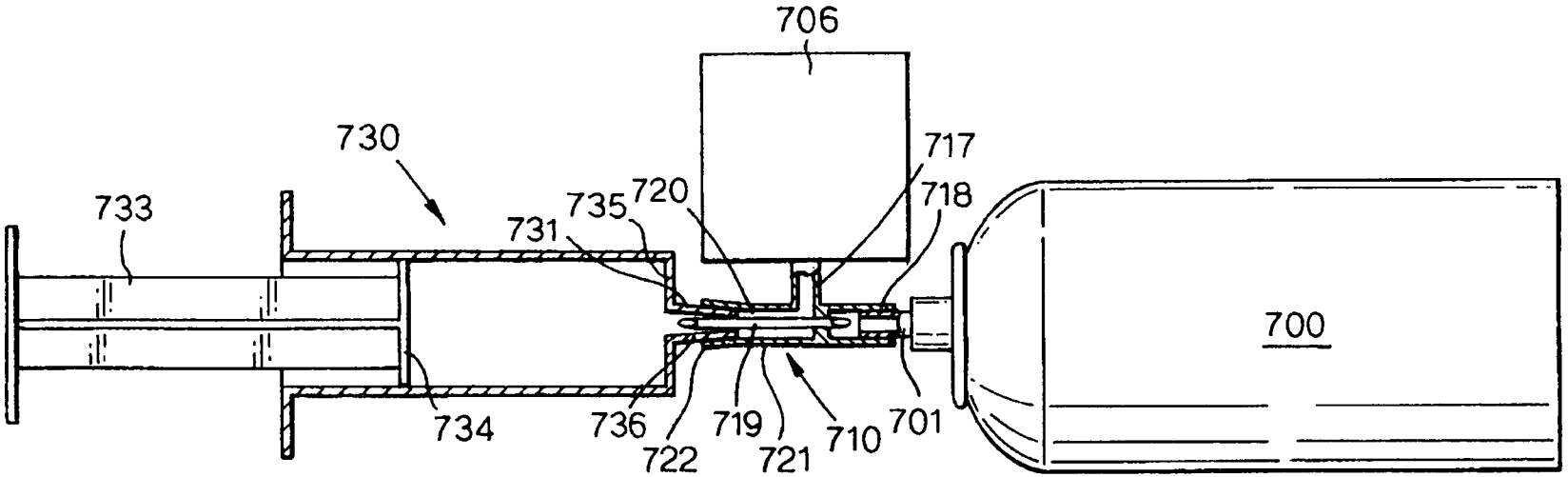
FIG. 19 is a sectional view of an eighth embodiment.

Referring now to FIG. 19, an eighth embodiment is shown.

A pressurised metal canister 700 is shown connected via its nozzle 701 to an inlet 718 of a foam dispensing device shown generally at 710. The device also has a waste outlet 717 leading to a flexible waste container 706. The dispensing device 710 also comprises a usable foam outlet member 719 which communicates with the inlet 718. The outlet member 719 is in the form of a tube such as a metal cannula which is mounted within the moulded plastics body of the device. A tubular limb 721 of the device surrounds the outlet member 719 so as to form an annular waste inlet 720 which communicates with the waste outlet 717. The end region of the tubular limb 721 is formed as a female luer connector 722.

A syringe 730 is shown connected, via a standard luer nozzle 731 to the luer connector 722 of the tubular limb 721. In this way, the nozzle 731 of the syringe communicates both with the foam outlet and the waste inlet of the device.

The outlet member and connector 722 are configured such that the outlet member reaches to, or almost to, the inner end 732 of the syringe nozzle and is of smaller diameter than that of the bore of the syringe nozzle. Thereby an annular region 736 is created within the syringe nozzle 731.

In use, the syringe plunger 733 is moved to the fully depressed position; the device 710 is then pressed down against the canister 700 so as to open the canister valve (not shown). Foam then flows from the canister, into the inlet 718 and through the foam outlet member 719, and thence into the syringe 730. With the syringe plunger closed there is perhaps a very small dead space between the face 734 of the plunger 733 and the interior end face 735 of the syringe as well as the annular region 736 in the bore of the syringe nozzle 731 which is not occupied by the outlet member 719. Together, these regions constitute the dead space in the syringe.

Foam from the canister 700 flows into this dead space in the syringe; initially the foam is of poor quality. The foam is fed continuously such that after a period, the foam becomes of consistent, acceptable quality. This may be observed by the user either in the syringe nozzle, or in the annular passage 736 (if the main plastics body of the device is transparent) or in the waste chamber, which may be transparent or translucent. When the flexible waste chamber is full, the back pressure generated will force the syringe plunger back so as to fill the syringe with good quality foam. Up to this point, the resistance to flow of foam through the annular space 736 and into the waste container 706 has been lower than that necessary to overcome the resistance to movement of the plunger 733.

The syringe may then be removed for use.

In a modified version of this embodiment, a non-standard syringe is used, which has a larger nozzle bore than that of a conventional luer nozzle. The connector 722 of the device is similarly sized.

It will be appreciated that a number of modifications to this embodiment are possible. It is not necessary to have a waste container, and the connector 722 could simply be formed so as to allow foam to leak out round the sides to the outlet member 719; all that is necessary if that respective formations are provided on the syringe and the device to hold the outlet member in position in the syringe nozzle bore so that a gap is formed between the outlet member and the bore of the nozzle.

It will also be appreciated that this type of outlet could be used with the other embodiments of dispensing device described above.

The invention claimed is:

1. A device for dispensing therapeutic foam comprising:

(a) a source of foam;

(b) an inlet for communication with the source of foam;

(c) a usable foam outlet;

(d) a waste outlet; and (e) a valve system connecting the inlet, usable foam outlet and waste outlet, wherein the valve has:

(i) a first state in which the inlet communicates via the valve system with the waste outlet, substantially to the exclusion of communication with the usable foam outlet;

(ii) a second state in which the inlet communicates with the usable foam outlet;

wherein during movement of the valve system between the first and second states, at no point is communication of the inlet with one or other of the usable foam and waste outlets shut off.

2. A device as claimed in claim 1 wherein a waste foam container is provided as an integral part of the device.

3. A device as claimed in claim 2 wherein the waste foam container has a transparent wall or portion of a wall to allow observation of the wasted foam so that the user can check when the foam is of sufficient consistent quality to be used.

4. A device as claimed in claim 2 comprising a housing which defines the outlets and which also defines the waste foam container.

5. A kit comprising a device as claimed in claim 1 together with a canister containing a source of liquid and gas for generating the foam.

6. A kit as claimed in claim 5 further comprising a syringe for administration of the foam.

7. A device as claimed in claim 1 wherein the waste chamber contains absorbent material.

* * * * *